US010869792B2

(12) United States Patent
Larsen et al.

(10) Patent No.: US 10,869,792 B2
(45) Date of Patent: Dec. 22, 2020

(54) PATIENT SUPPORT APPARATUS

(71) Applicant: Stryker Corporation, Kalamazoo, MI (US)

(72) Inventors: Lance Erick Larsen, Grand Rapids, MI (US); Christopher Ryan Sweeney, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 252 days.

(21) Appl. No.: 15/693,722

(22) Filed: Sep. 1, 2017

(65) Prior Publication Data

US 2018/0064589 A1 Mar. 8, 2018

Related U.S. Application Data

(60) Provisional application No. 62/382,883, filed on Sep. 2, 2016.

(51) Int. Cl.
*A61G 5/00* (2006.01)
*A61G 5/14* (2006.01)
(Continued)

(52) U.S. Cl.
CPC ..... *A61G 5/006* (2013.01); *A61G 5/14* (2013.01); *A61G 7/005* (2013.01); *A61G 7/012* (2013.01);
(Continued)

(58) Field of Classification Search
CPC .... A61H 2201/0107; A61H 2201/0142; A61H 2201/0161; A61H 2201/0192;
(Continued)

(56) References Cited

U.S. PATENT DOCUMENTS 3,085,258 A 4/1963 Wolferts
4,724,555 A 2/1988 Poehner et al.
(Continued)

FOREIGN PATENT DOCUMENTS

AU 2010202928 A1 1/2011
CN 101077325 A 11/2007
(Continued)

OTHER PUBLICATIONS

L.L. Bean Inc., "Camp Comfort Recliner", URL: https://www.llbean.com/llb/shop/111730?page=llbean-camp-comfort-recliner.
(Continued)

*Primary Examiner* — Nicholas F Polito
*Assistant Examiner* — Morgan J McClure
(74) *Attorney, Agent, or Firm* — Howard & Howard Attorneys PLLC

(57) ABSTRACT

A modular patient support system for use in ambulating a patient across a floor, comprising a primary module and a secondary module. The primary module has a primary base and a primary deck arranged for movement relative to the primary base, and the primary deck defines a first patient support area. The secondary module has a secondary base adapted for movement along the floor relative to the primary base and a secondary deck arranged for movement relative to the secondary base. The modular patient support system is operable between a docked configuration where the secondary deck cooperates with the primary deck to define a second patient support area larger than the first patient support area, and an undocked configuration where the secondary module is spaced apart from the primary module to facilitate ambulation concurrent with the secondary module across the floor away from the primary module.

22 Claims, 17 Drawing Sheets

(51) Int. Cl.

| | |
|---|---|
| ***A61G 7/005*** | (2006.01) |
| ***A61G 7/012*** | (2006.01) |
| ***A61G 7/015*** | (2006.01) |
| ***A61G 7/018*** | (2006.01) |
| ***A61H 3/04*** | (2006.01) |
| ***A61G 7/16*** | (2006.01) |
| ***A61G 7/05*** | (2006.01) |
| ***A61G 7/053*** | (2006.01) |

(52) U.S. Cl.

CPC ..... *A61G 7/015* (2013.01); *A61G 7/018* (2013.01); *A61G 7/16* (2013.01); *A61H 3/04* (2013.01); *A61G 7/05* (2013.01); *A61G 7/053* (2013.01); *A61G 7/0506* (2013.01); *A61G 7/165* (2016.11); *A61H 2003/043* (2013.01); *A61H 2201/0107* (2013.01); *A61H 2201/0142* (2013.01); *A61H 2201/0161* (2013.01); *A61H 2201/0192* (2013.01)

(58) Field of Classification Search

CPC .... A61H 2003/043; A61H 3/04; A61G 7/005; A61G 7/012; A61G 7/015; A61G 7/018; A61G 7/16; A61G 7/165; A61G 5/006; A61G 5/14; A61G 7/05; A61G 7/0506; A61G 7/053

See application file for complete search history.

(56) References Cited

U.S. PATENT DOCUMENTS

| | | | | |
|---|---|---|---|---|
| 4,805,249 | A | 2/1989 | Usman et al. | |
| 4,819,283 | A | 4/1989 | DiMatteo et al. | |
| 4,987,620 | A * | 1/1991 | Sharon | A61G 5/006 5/600 |
| 5,103,511 | A | 4/1992 | Sequin | |
| 5,134,737 | A | 8/1992 | Wyman | |
| 5,230,113 | A | 7/1993 | Foster et al. | |
| 5,257,426 | A | 11/1993 | Leoutsakos | |
| 5,299,334 | A | 4/1994 | Gonzalez | |
| 5,398,357 | A | 3/1995 | Foster | |
| 5,465,744 | A * | 11/1995 | Browning | A61G 7/053 135/67 |
| 5,513,406 | A * | 5/1996 | Foster | A61G 7/00 177/1 |
| 5,555,582 | A * | 9/1996 | Jerideau | A61G 5/006 5/600 |
| 5,613,252 | A | 3/1997 | Yu et al. | |
| 5,680,661 | A * | 10/1997 | Foster | A61G 7/0015 5/604 |
| 5,715,548 | A | 2/1998 | Weismiller et al. | |
| 6,374,436 | B1 * | 4/2002 | Foster | A61G 7/0015 5/624 |
| 6,397,416 | B2 | 6/2002 | Brooke et al. | |
| 6,640,360 | B2 | 11/2003 | Hornbach et al. | |
| 6,694,548 | B2 | 2/2004 | Foster et al. | |
| 6,725,474 | B2 | 4/2004 | Foster et al. | |
| 6,851,142 | B2 | 2/2005 | Stryker et al. | |
| 7,636,966 | B2 | 12/2009 | Gallant et al. | |
| 7,716,762 | B2 | 5/2010 | Ferraresi et al. | |
| 7,761,942 | B2 | 7/2010 | Benzo et al. | |
| 7,886,379 | B2 | 2/2011 | Benzo et al. | |
| 8,336,133 | B2 | 12/2012 | Palay et al. | |
| 8,474,076 | B2 | 7/2013 | Hornbach | |
| 8,578,531 | B2 | 11/2013 | Abernathey et al. | |
| 8,677,524 | B2 | 3/2014 | Kume et al. | |
| 8,793,824 | B2 | 8/2014 | Poulos et al. | |
| 8,844,075 | B2 * | 9/2014 | Heimbrock | A61G 7/002 5/181 |
| 8,864,205 | B2 | 10/2014 | Lemire et al. | |
| 8,959,681 | B2 | 2/2015 | Richards | |
| 8,973,187 | B2 | 3/2015 | Hornbach | |
| 9,138,173 | B2 | 9/2015 | Penninger et al. | |
| 9,306,322 | B2 | 4/2016 | Bhimavarapu et al. | |
| 9,414,980 | B2 * | 8/2016 | Kume | A61G 5/1067 |
| 9,940,810 | B2 | 4/2018 | Derenne et al. | |
| 2003/0052787 | A1 | 3/2003 | Zerhusen et al. | |
| 2004/0064886 | A1 | 4/2004 | Alverson et al. | |
| 2004/0133979 | A1 * | 7/2004 | Newkirk | A61G 13/0036 5/600 |
| 2004/0177445 | A1 | 9/2004 | Osborne et al. | |
| 2006/0085914 | A1 | 4/2006 | Peterson et al. | |
| 2006/0130239 | A1 | 6/2006 | Smith | |
| 2010/0017964 | A1 | 1/2010 | Kruse | |
| 2010/0064439 | A1 | 3/2010 | Soltani | |
| 2010/0212087 | A1 | 8/2010 | Leib et al. | |
| 2011/0162142 | A1 | 7/2011 | Hakamiun et al. | |
| 2012/0117732 | A1 | 5/2012 | O'Keefe | |
| 2012/0124745 | A1 | 5/2012 | Heimbrock et al. | |
| 2012/0137439 | A1 | 6/2012 | Heimbrock | |
| 2012/0169093 | A1 * | 7/2012 | Kume | A61G 5/04 297/118 |
| 2012/0198626 | A1 | 8/2012 | Richards | |
| 2012/0198628 | A1 * | 8/2012 | Richards | A61G 7/012 5/618 |
| 2012/0297544 | A1 * | 11/2012 | Griswold | A61G 5/10 5/618 |
| 2013/0212807 | A1 | 8/2013 | Manson et al. | |
| 2013/0227787 | A1 | 9/2013 | Herbst et al. | |
| 2014/0167388 | A1 * | 6/2014 | Wilde | A61G 5/1043 280/304.1 |
| 2015/0115628 | A1 | 4/2015 | Wittelsbuerger et al. | |
| 2015/0115638 | A1 | 4/2015 | Lambarth et al. | |
| 2015/0164722 | A1 | 6/2015 | Roussy et al. | |
| 2016/0013837 | A1 | 1/2016 | Howell et al. | |
| 2016/0022039 | A1 | 1/2016 | Paul et al. | |
| 2016/0089283 | A1 | 3/2016 | DeLuca et al. | |
| 2016/0193095 | A1 | 7/2016 | Roussy et al. | |
| 2016/0302985 | A1 | 10/2016 | Tessmer et al. | |
| 2017/0056267 | A1 | 3/2017 | Stryker et al. | |
| 2017/0079434 | A1 | 3/2017 | Paul et al. | |
| 2017/0172829 | A1 | 6/2017 | Tessmer et al. | |
| 2018/0000670 | A1 | 1/2018 | Bartley et al. | |
| 2018/0000672 | A1 | 1/2018 | Heneveld, Jr. et al. | |
| 2018/0000673 | A1 | 1/2018 | Bartley | |
| 2018/0000674 | A1 | 1/2018 | Bartley | |
| 2018/0000675 | A1 | 1/2018 | Heneveld, Jr. et al. | |
| 2018/0064591 | A1 | 3/2018 | Sweeney et al. | |
| 2018/0064592 | A1 | 3/2018 | Sweeney et al. | |
| 2018/0190100 | A1 | 7/2018 | Derenne et al. | |

FOREIGN PATENT DOCUMENTS

| | | | |
|---|---|---|---|
| DE | 4039253 | A1 | 6/1992 |
| EP | 262771 | A1 | 4/1988 |
| EP | 932385 | B1 | 3/2004 |
| EP | 2481388 | A1 | 8/2012 |
| EP | 2484326 | A2 | 8/2012 |
| EP | 2481388 | B1 | 11/2015 |
| GB | 905708 | A | 9/1962 |
| JP | 2014188340 | A | 10/2014 |
| KR | 2013-0076922 | | 7/2013 |
| KR | 20130076922 | A | 7/2013 |
| WO | 2007055051 | A1 | 5/2007 |
| WO | 2015126742 | A1 | 8/2015 |
| WO | 2016171746 | A1 | 10/2016 |

OTHER PUBLICATIONS

Positive Posture LLC, "Luma Designer Recliner", URL: https://www.positiveposture.com/products/recliners/luma/.

Hill-Rom Services, Inc., "Progressa(TM) Bed System, Technical Specifications", 2013; 4 pages.

Hill-Rom Services, Inc., "Progressa(TM) Bed System, Advancing mobility. Accelerating Recovery." 2013; 16 pages.

English language abstract and machine-assisted translation for DE4039253 extracted from espacenet.com on Mar. 27, 2018; 5 pages.

English language abstract and machine-assisted translation for CN101077325 extracted from espacenet.com on Mar. 27, 2018; 4 pages.

(56) References Cited

OTHER PUBLICATIONS

English language abstract for JP5432400 extracted from espacenet.com on Mar. 27, 2018; 1 page.
English language abstract for WO2007055051 extracted from espacenet.com on Mar. 27, 2018; 1 page.
English language abstract and machine-assisted English translation for KR 2013-0076922 extracted from espacenet.com database on Aug. 20, 2018, 8 pages.

* cited by examiner

PATIENT SUPPORT APPARATUS

CROSS-REFERENCE TO RELATED APPLICATION

This application claims priority to and the benefit of U.S. Provisional Patent Application No. 62/382,883, filed on Sep. 2, 2016, which is hereby incorporated by reference in its entirety.

BACKGROUND

Patient support apparatuses, such as hospital beds, stretchers, cots, tables, and wheelchairs, facilitate care of patients in a health care setting. Conventional patient support apparatuses comprise a base, a support frame, a patient support deck operatively attached to the support frame, a lift assembly for lifting and lowering the support frame relative to the base, and actuators arranged to move sections of the patient support deck relative to the support frame.

Certain conventional patient support apparatuses, such as those realized as hospital beds, are primarily employed to provide support to a patient lying on the patient support deck. To that end, one or more sections of the patient support deck provide support to the patient's head, torso, legs, and feet, allowing the patient to lay on their side, on their back in a supine position, and the like. In addition, one or more sections of the patient support deck can typically be moved or oriented relative to one another to promote patient comfort and to help facilitate patient mobility. By way of example, the patient support deck may be movable into a fowler's position to allow the patient to lay upright.

In order to allow the patient to exit the hospital bed, the lift assembly is used to lower the patient support deck towards the base so as to position the patient vertically near the floor. Next, the patient re-orients their body to bring their legs and feet into contact with the floor at one side of the patient support apparatus. To this end, the patient typically sits upright and turns sideways while moving their legs and feet away from the patient support deck to bring their feet into contact with the floor to stand.

It will be appreciated that the process of successfully exiting a patient support apparatus without assistance is often an important component of physical and/or occupational therapy. The patient may not be cleared to leave a hospital after a surgical procedure until they are able to exit the hospital bed unassisted. However, the process of exiting the hospital bed can be difficult for patients under certain circumstances. By way of example, if the patient is recovering from a complex medical procedure and/or a serious injury, he or she may be unable to re-orient his or her body, turn, and/or stand without the help of a medical professional. Similarly, if the patient is obese, he or she may require the help of multiple medical professionals to exit the bed. Under such circumstances, it is possible for patients fall and injure themselves.

Certain patient support apparatuses known in the related art are configured to position the patient near the floor without necessitating that the patient turn on the patient support deck to position their legs and feet to stand. Such patient support apparatuses are configured to allow the patient to be moved to a seated position to exit at a foot end of the patient support apparatus as opposed to a side, as described above. However, patient support apparatuses of this type tend to employ complex lift systems and linkages between the sections of the patient support deck to facilitate movement from a laying position to a seated position. Thus, such patient support systems tend to be bulky, relatively expensive to manufacture, and complicated to use.

Accordingly, there remains a need in the art for a patient support apparatus which overcomes the disadvantages in the prior art.

DETAILED DESCRIPTION

Figure 1:
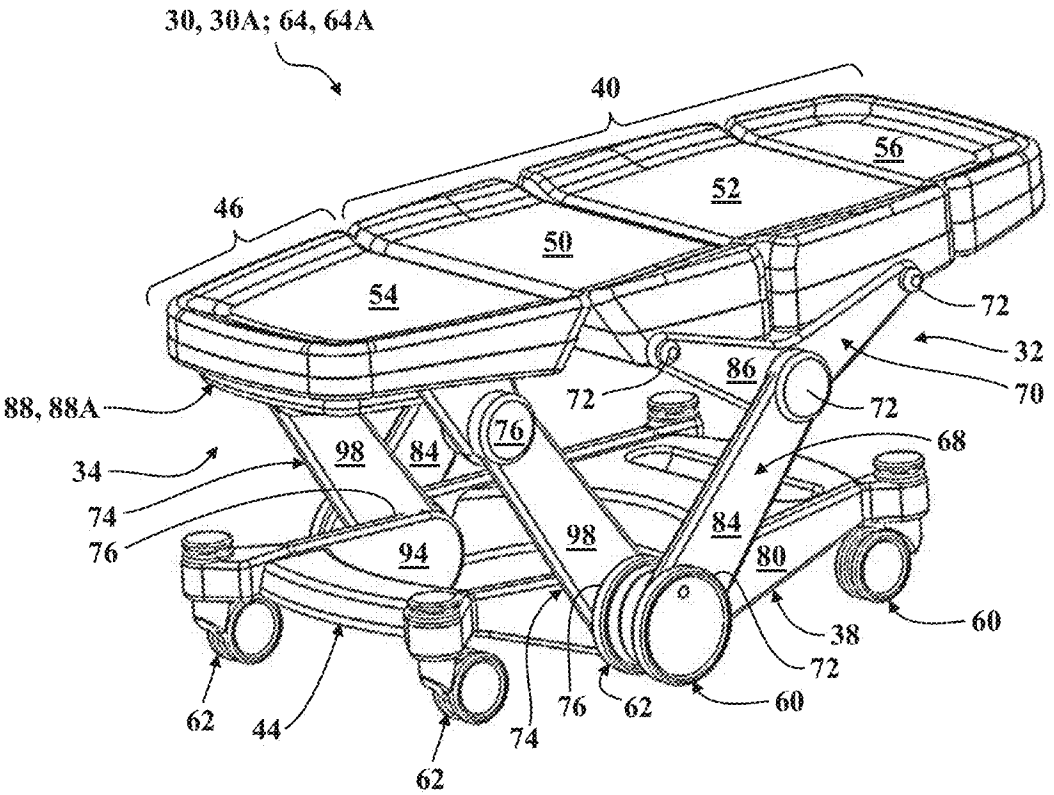
FIG. 1 is a perspective view of a modular patient support system arranged in a bed configuration, the modular patient support system shown in a docked configuration and comprising a primary patient support module and a secondary patient support module.

Referring to FIG. 1, a modular patient support system 30 is shown for supporting a patient in a health care setting. The modular patient support system 30 is comprised of a primary patient support module 32 and a secondary patient support module 34 which cooperate to provide support to the patient when lying or seated, and which are configured for use in facilitating ambulation of the patient across a floor 36, as described in greater detail below.

The primary patient support module 32 is comprised of a primary base 38 and a primary support deck 40 arranged for movement relative to the primary base 38. Here, the primary support deck 40 provides support to the patient and defines a first patient support area 42, as described in greater detail below, which is depicted in FIGS. 7-9 and 17A by a contiguous dash-dot-dash line arranged adjacent to the primary support deck 40. The secondary patient support module 34, in turn, is comprised of a secondary base 44 and a secondary support deck 46 arranged for movement relative to the secondary base 44.

Figure 2:
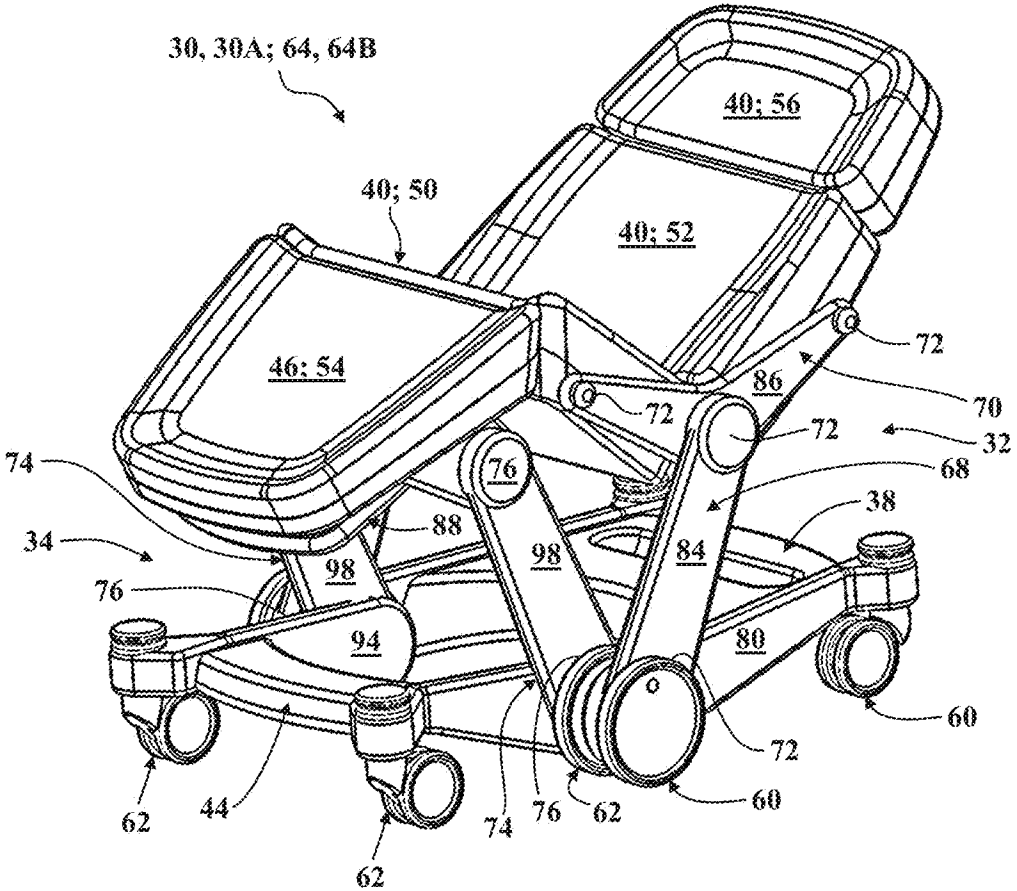
FIG. 2 is another perspective view of the modular patient support system of FIG. 1 shown arranged in another bed configuration.
Figure 3:
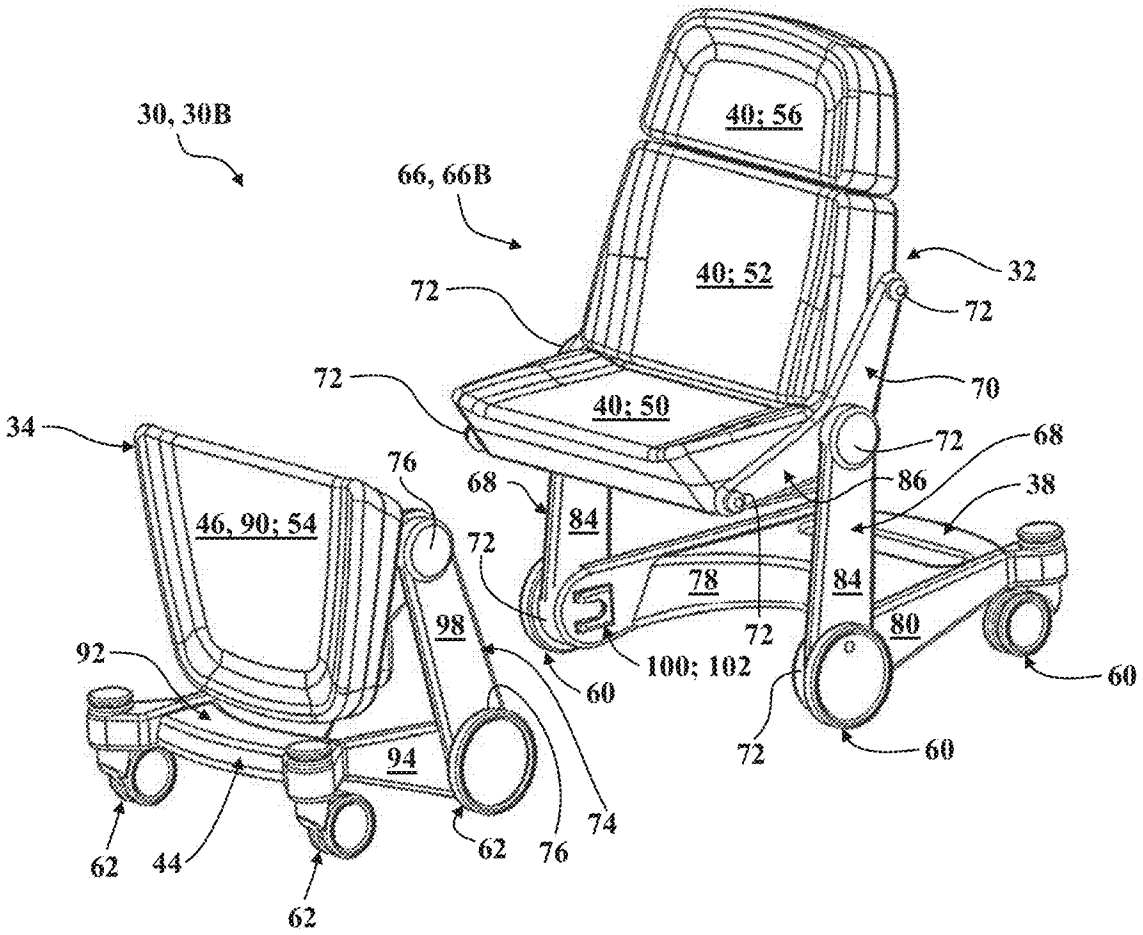
FIG. 3 is another perspective view of the modular patient support system of FIGS. 1-2 shown in an undocked configuration with the secondary patient support module spaced from the primary patient support module, the primary patient support module shown arranged in an elevated chair configuration, and the secondary patient support module shown having a grip arranged in a stowed configuration.
Figure 4:
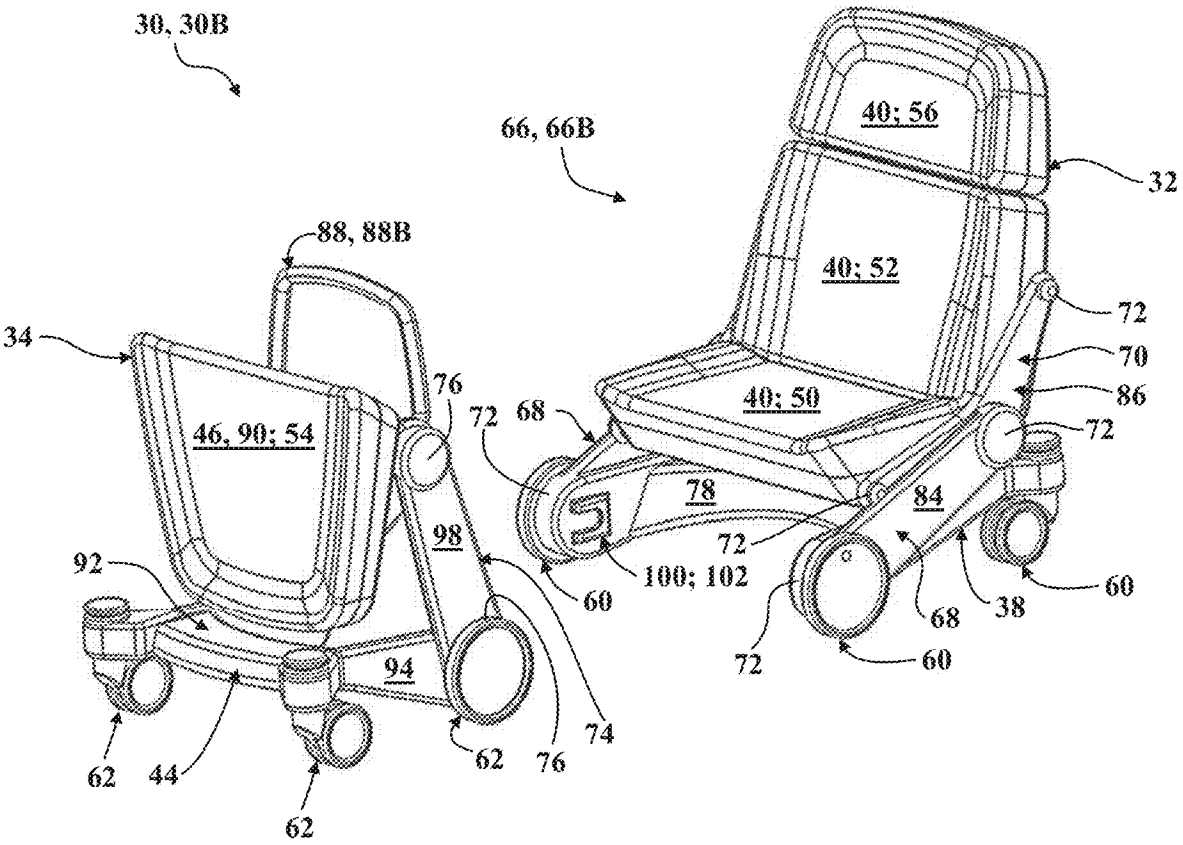
FIG. 4 is another perspective view of the modular patient support system of FIGS. 1-2 shown in the undocked configuration with the secondary patient support module spaced from the primary support module, the primary patient support module shown arranged in a lowered chair configuration, and the secondary patient support module shown with the grip arranged to a patient ambulation configuration.
Figure 5:
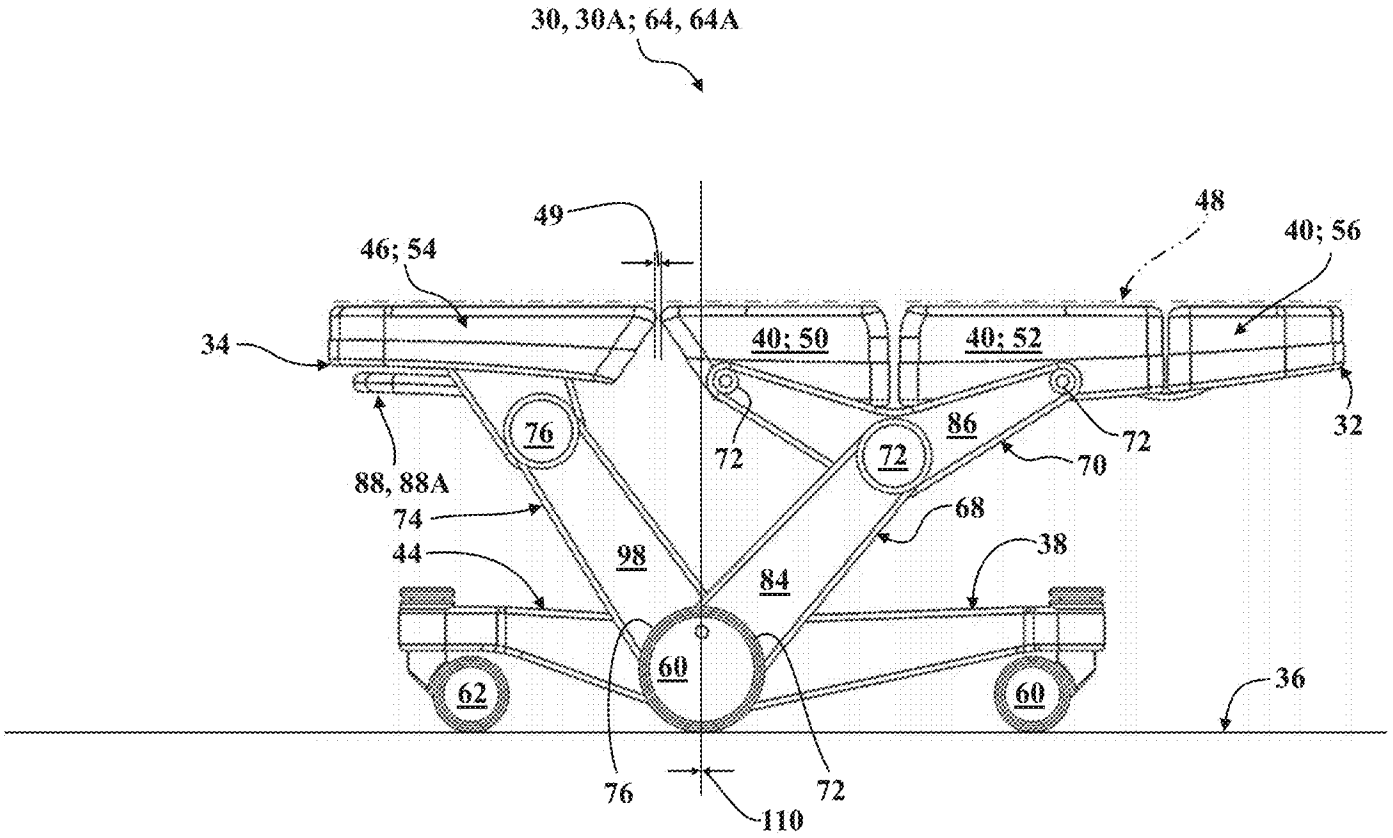
FIG. 5 is a left-side view of the modular patient support system arranged as depicted in FIG. 1.
Figure 6:
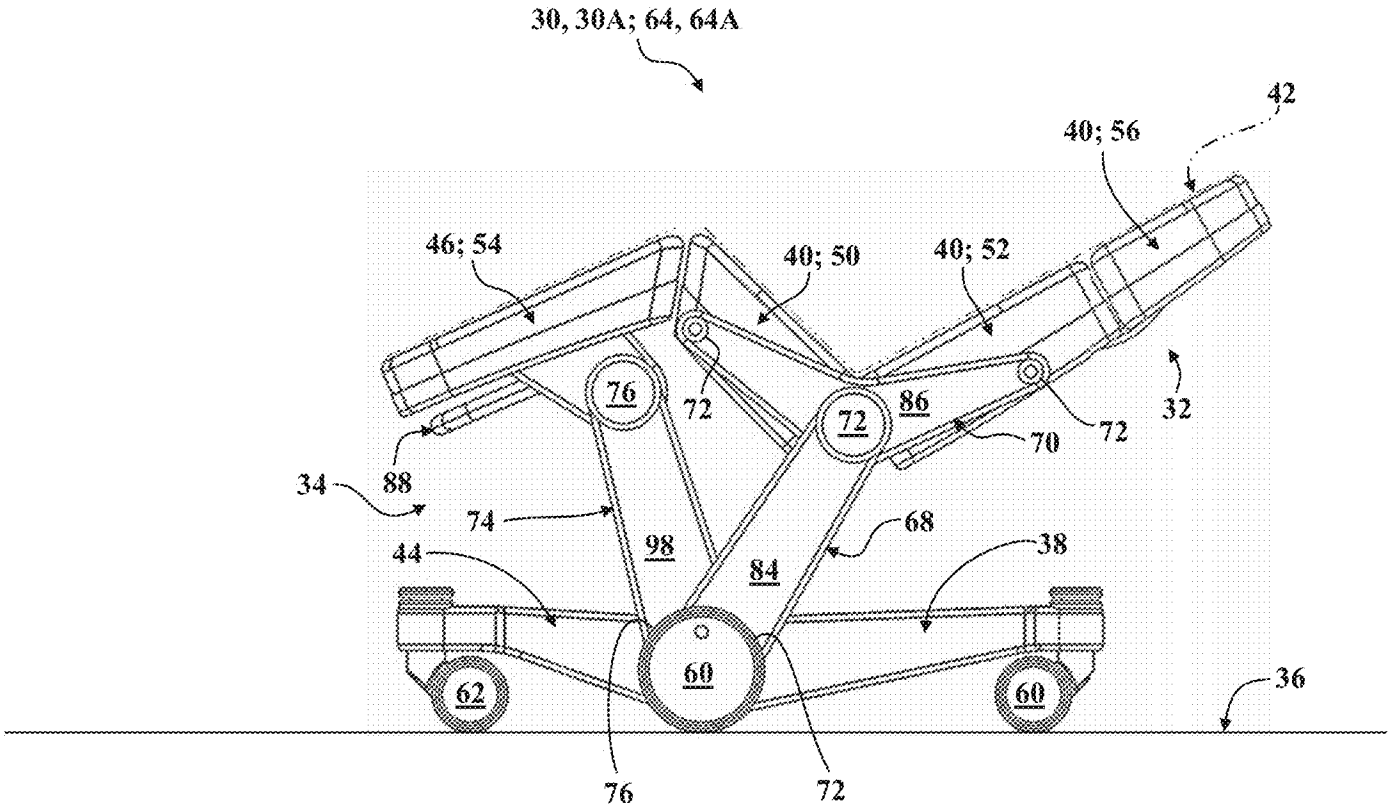
FIG. 6 is a left-side view of the modular patient support system arranged as depicted in FIG. 2.
Figure 17A:
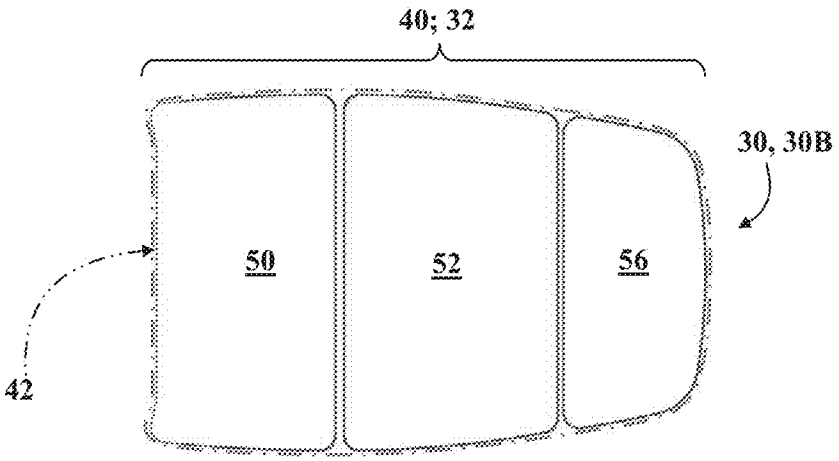
FIG. 17A is a partial top-side schematic view of the modular patient support system arranged as depicted in FIG. 1, showing a first patient support area defined by the primary patient support module.
Figure 17B:
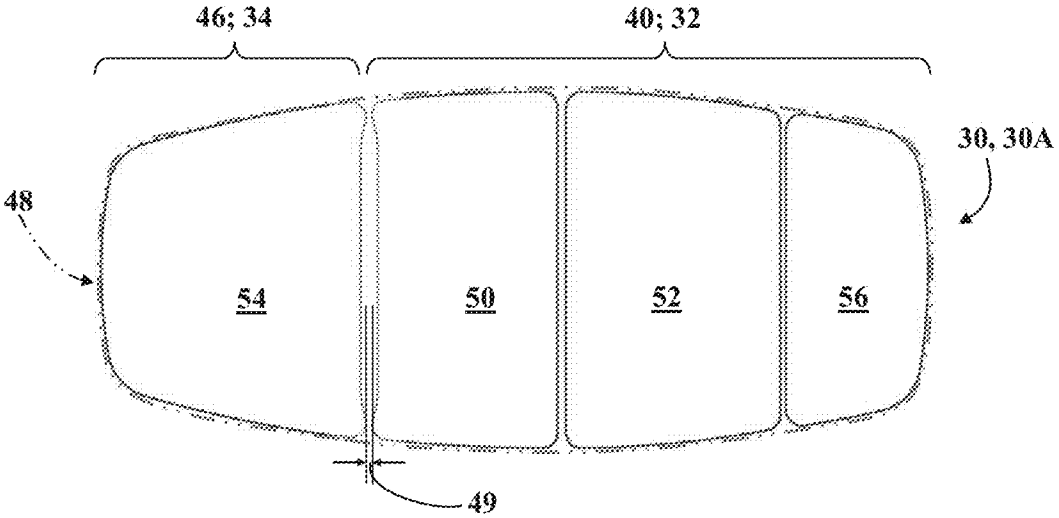
FIG. 17B is a partial top-side schematic view of the modular patient support system arranged as depicted in FIG. 1, showing a second patient support area defined by the primary patient support module and the secondary patient support module.

Referring now to FIGS. 1-9 and 17A-17B, the modular patient support system 30 is operable between a docked configuration 30A (see FIGS. 1 and 2) and an undocked configuration 30B (see FIGS. 3 and 4). In the docked configuration 30A, the secondary support deck 46 cooperates with the primary support deck 40 to define a second patient support area 48 larger than the first patient support area 42, which is depicted in FIGS. 5-6 and 17B by a contiguous dash-dot-dot-dash line arranged adjacent to both the primary support deck 40 and the secondary support deck 46. The first and second patient support areas are not particularly limited, and in certain configurations, the first patient support area may be at least 25, 50, 75, 100, 150, 200, or 250% larger than the second patient support area. In the undocked configuration 30B, the secondary patient support module 34 is spaced apart from the primary patient support module 32 to facilitate patient egress and ambulation concurrent with the secondary patient support module 34 across the floor 36 away from the primary patient support module 32. As is best shown in FIGS. 5 and 17B, it will be appreciated that a gap 49 may exist between the primary support deck 40 and the secondary support deck 46 when the modular patient support system 30 operates in the docked configuration 30A, so long as the gap has a dimension small enough to prevent pinching of the patient. For example, the gap 49 may be less than 10.5 or 3 cm.

As is described in greater detail below, the first patient support area 42 is realized as a contiguous surface area of the primary support deck 40 upon which the patient can be supported (see FIGS. 5, 6, and 17A), and the second patient support area 48 is similarly realized as a contiguous surface area of both the primary support deck 40 and the secondary support deck 46 upon which the patient can be supported (see FIGS. 7-9 and 17B). Thus, when the modular patient support system 30 operates in the docked configuration 30A, both the primary support deck 40 and the secondary support deck 46 support the patient and cooperate to define the contiguous second patient support area 48 (see FIGS. 5, 6, and 17A). Specifically, the second patient support area 48 serves as a bed to provide support to the patient's head, torso, legs, and feet, allowing the patient to lay on their side, on their back in a supine position, and the like.

Conversely, when the modular patient support system 30 operates in the undocked configuration 30B, the primary support deck 40 supports the patient and defines the contiguous first patient support area 42, while the secondary support deck 46 does not provide support to the patient (see FIGS. 7-9 and 17B; compare with FIGS. 5, 6, and 17A). Specifically, the first patient support area 42 serves as a chair to provide support to the patient's head, torso, buttocks, and upper legs, allowing the patient to sit in various orientations. Here too in the undocked configuration 30B, the secondary patient support module 34 can be moved away from the primary patient support module 32 to allow the patient uninhibited access to the floor 36 to stand. As is described in greater detail below, the secondary patient support module 34 can be moved away from the patient and stored elsewhere, such as where the patient does not require ambulation assistance, or the secondary patient support module 34 can be configured to serve as a walking aid for the patient to assist with ambulation, such as where the patient requires the use of a "walker" for ambulation. Moreover, it will be appreciated that the secondary patient support module 34 can also be configured to serve other purposes when the modular patient support system 30 operates in the undocked configuration 30B. By way of non-limiting example, the secondary patient support module 34 may also serve as a movable table, a storage cart, and the like. The primary patient support module 32 and the secondary patient support module 34 will each be described in greater detail below.

With continued reference to FIGS. 1-4, in the representative embodiment illustrated herein, the primary support deck 40 of the primary patient support module 32 comprises a seat section 50 and a back section 52 arranged for movement relative to each other and to the primary base 38 (compare FIGS. 1 and 2). Similarly, the secondary support deck 46 of the secondary patient support module 34 comprises a foot section 54 arranged for movement relative to the secondary base 44 (compare FIGS. 1 and 2). In one embodiment, the primary support deck 40 also includes a head section 56 operatively attached to the back section 52 for concurrent movement therewith. It will be appreciated that the use of the terms "foot," "back," "seat," and/or "head" herein are intended to be illustrative and non-limiting. Specifically, it will be appreciated that one or more of the sections 50, 52, 54, 56 could be employ to directly or indirectly support any suitable portion of the patient's body and, thus, could be defined in any suitable way.

The primary support deck 40 and the secondary support deck 46 may support or otherwise include portions of a mattress (not shown in detail) to promote patient comfort during use. In such circumstances, the portions of the mattress may cooperate to comprise a patient support surface upon which the patient is directly supported. However, those having ordinary skill in the art will appreciate that direct support of the patient could be effected in a number of different ways. By way of non-limiting example, the patient support apparatus 30 could employ a separate, modular, unitary mattress adapted to be placed upon the primary and secondary support decks 40, 46, a portion of the intermediate frame, and the like. Moreover, it will be appreciated that the patient support apparatus 30 could be configured in a number of different ways and, thus, any suitable component of the patient support apparatus 30 could provide support to the patient, either directly or indirectly.

As shown in FIG. 1, the primary support deck 40 also includes a head section 56 operatively attached to the back section 52 for concurrent movement therewith, as noted above. In the representative embodiment illustrated throughout the drawings, the head section 56 and the back section 52 are realized as discrete components which are coupled to each other. However, those having ordinary skill in the art will appreciate that the head section 56 could be movable with respect to the back section 52, or could otherwise be integrated with the back section 52. Furthermore, those having ordinary skill in the art will appreciate that the modular patient support system 30 could employ any suitable number of sections, decks, and/or patient support surfaces adapted to provide support to any suitable part of the patient's body.

It will be appreciated that the modular patient support system 30 could be configured in a number of different ways and could include additional features or components conventionally employed in connection with patient support apparatuses. By way of non-limiting example, a removable foot board may be provided for being coupled to the foot section 54 of the secondary support deck 46 for use in certain applications, or the foot board may alternatively be integrally formed with the foot section 54 (not shown, but generally known in the related art). In addition, side rails and/or a head board may be operatively attached to or otherwise integrated with portions of the primary patient support module 32 and/or the secondary patient support module 34 (not shown, but generally known in the related art). Side rails conventionally employed in connection with patient support apparatuses are generally configured to be movable between a raised position in which they block patient ingress and egress, one or more intermediate positions, and a lowered position in which they are not an obstacle to such ingress and egress.

As is best shown in FIGS. 1-4 and 10-11, the primary patient support module 32 employs primary wheels 60 to support the primary base 38 for movement along the floor 36. In the embodiment shown, the primary base 38 is supported by two powered primary wheels, as well as by two non-powered caster primary wheels. Similarly, the secondary patient support module 34 employs secondary wheels 62 to support the secondary base 44 for movement along the floor 36, with two powered secondary wheels, as well as two non-powered caster secondary wheels. However, those having ordinary skill in the art will appreciate that various configurations of primary wheels 60 and/or secondary wheels 62 are contemplated. By way of non-limiting example, the primary patient support module 32 and/or the secondary patient support module 34 could employ any suitable number of wheels 60, 62, either powered or non-powered, steerable or non-steerable, arranged in any suitable way. In some cases, the primary patient support apparatus 32 and/or the secondary patient support apparatus 34 may not include any wheels. In other embodiments, one or more auxiliary wheels (powered or non-powered), which are movable between stowed positions and deployed positions, may be provided.

As is shown best in FIGS. 1 and 2, the seat section 50 and the back section 52 of the primary patient support module 32 and the foot section 54 of the secondary patient support module 34 are movable between various bed configurations 64 when the patient support system 30 is in the docked configuration 30A. In each of the bed configurations 64, the seat section 50, the back section 52, and the foot section 54 cooperate to define the second patient support area 48 in a contiguous manner and are each arranged for at least partially supporting the patient. Similarly, as is shown in FIGS. 3 and 4, the seat section 50 and the back section 52 of the primary patient support module 32 are movable between various chair configurations 66 when the modular patient support system 30 is in the undocked configuration 30B. Here, in each of the chair configurations 66, the seat section 50 and the back section 52 cooperate to define the first patient support area 42 and are each arranged for at least partially supporting the patient, with the foot section 54 spaced from the primary patient support module 32 and out of support of the patient. In other words, when the modular patient support system is in the undocked configuration, the patient support surface defined by the back and seat sections are not contiguous with the patient support surface of the foot section.

It will be appreciated that the bed configurations 64 are generally intended for supporting the patient in a lying orientation, such as on the back or side, while the chair configurations 66 are generally indented for supporting the patient in a seated orientation, such as may be employed to promote patient ambulation away from the primary patient support module 32, as noted above. Thus, when the patient support system 30 operates in the docked configuration 30A, the secondary base 44 moves concurrently along the floor 36 with the primary base 38. Conversely, when the patient support system 30 operates in the undocked configuration 30B, the secondary patient support module 34 may be moved away from the primary patient support module 32 so as to promote uninhibited access to the floor 36 while the seated patient is supported in one of the chair configurations 66. The docked configuration 30A, the undocked configuration 30B, the bed configurations 64, and the chair configurations 66 will each be described in greater detail below.

As noted above, the seat section 50 and the back section 52 of the primary support deck 40 are arranged for movement relative to each other and to the primary base 38. To that end, in the representative embodiment illustrated throughout the drawings, the primary patient support module 32 comprises a primary intermediate frame 68, a primary positioning frame 70, and one or more primary actuators 72. The primary intermediate frame 68 is coupled to the primary base 38 and also to the seat section 50 and the back section 52 of the primary support deck 40 to allow movement of the seat section 50 and the back section 52 relative to the primary base 38. Here, a primary actuator 72 is arranged to move the primary intermediate frame 68 relative to the primary base (compare FIG. 3 to FIG. 4; see also FIGS. 6-9). The primary positioning frame 70, in turn, is interposed between the primary intermediate frame 68 and the seat section 50 and the back section 52 to allow for movement of the seat section 50 and the back section 52 relative to each other and to the primary intermediate frame 68. Here too, a primary actuator 72 is arranged to move the primary positioning frame 70 relative to the primary intermediate frame 68. Similarly, a primary actuator 72 is arranged to move the back section 52 of the primary support deck 40 relative to the primary positioning frame 70, and a primary actuator 72 is arranged to move the seat section 50 of the primary support deck 40 relative to the primary positioning frame 70 (compare FIGS. 2-4; see also FIGS. 5-9).

In the representative embodiment illustrated herein, the primary actuators 72 realized as rotary actuators arranged at each of the pivot points of the primary patient support module 32 described above. However, it will be appreciated that certain pivot points of the primary patient support module 32 could be manually-articulated or otherwise moved without the use of a discrete primary actuator, such as with an adjustable linkage. Similarly, those having ordinary skill in the art will appreciate that the primary patient support module 32 could employ any suitable number of primary actuators 72, of any suitable type, configuration, or arrangement sufficient to effect movement of the primary support deck 40 relative to the primary base 38. Specifically, it will be appreciated that the primary actuators 72 could alternatively be realized as one or more linear actuators arranged to move one or more sections of the primary support deck 40 with respect to the primary base 38. Furthermore, it will be appreciated that one of the patient support modules 32, 34 could be non-powered when the modular patient support system 30 is in the undocked configuration 30B and could receive power, rotational torque, and the like from the other of the patient support modules 32, 34 when in the docked configuration 30A. By way of non-limiting example, the secondary patient support module 34 could omit actuators entirely and could employ a linkage or gearset which receives torque from one or more primary actuators 72 of the primary patient support module 32 when in the docked configuration 30A so as to move between patient support configurations or positions, with the secondary patient support module 34 being manually operable or adjustable when in the undocked configuration 30B.

As noted above, the foot section 54 of the secondary support deck 46 is arranged for movement relative to the secondary base 44. To that end, in the representative embodiment illustrated throughout the drawings, the secondary patient support module 32 further comprises a secondary intermediate frame 74 and one or more secondary actuators 76. The secondary intermediate frame 74 is coupled to the secondary base 44 and also to the foot section 54 of the secondary support deck 46 to allow movement of the foot section 54 relative to the secondary base 44. Here, a secondary actuator 76 is arranged to move the secondary intermediate frame 74 relative to the secondary base 44. Similarly, a secondary actuator 76 is also arranged to move the foot section 54 relative to the secondary intermediate frame 74 (compare FIGS. 1-3; see also FIGS. 5-6). As will be appreciated from the subsequent description below, this arrangement also allows the foot section 54 of the secondary support deck 46 of the secondary patient support module 34 to be moved and/or positioned relative to the primary support deck 40 of the primary patient support module 32 under certain operating conditions. As was the case with the primary actuators 72 described above, the secondary actuators 76 are also realized as rotary actuators arranged at each of the pivot points of the secondary patient support module 34 described above, and it will be appreciated that certain pivot points could be manually-articulated or otherwise moved without a discrete actuator, such as with a linkage. Moreover, the secondary patient support module 34 could likewise employ any suitable number of secondary actuators 76 of any suitable type, configuration, or arrangement sufficient to effect movement of the secondary support deck 46 relative to the secondary base 44.

Figure 10:
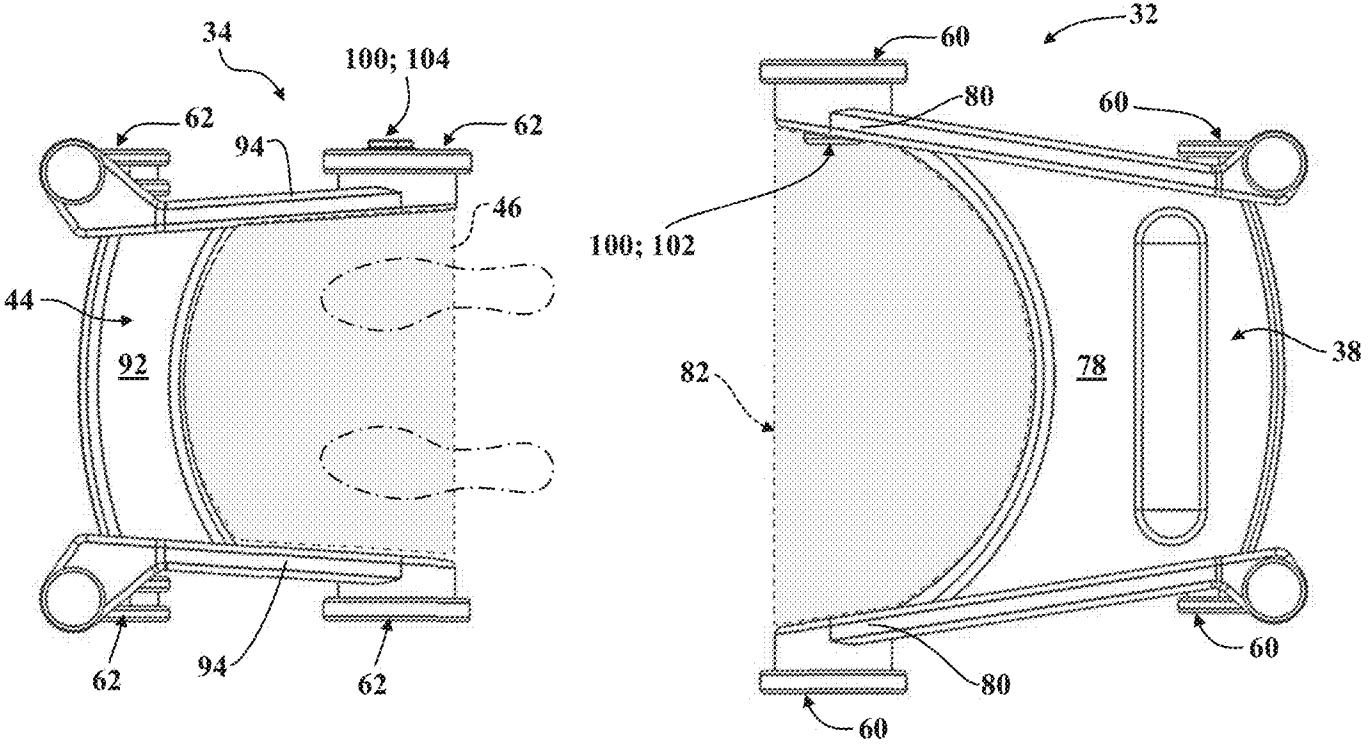
FIG. 10 is a top-side view showing a primary base of the primary patient support module spaced from a secondary base of the secondary patient support module, the primary base shown defining a floor access region and the secondary base shown defining a walking access region.
Figure 11:
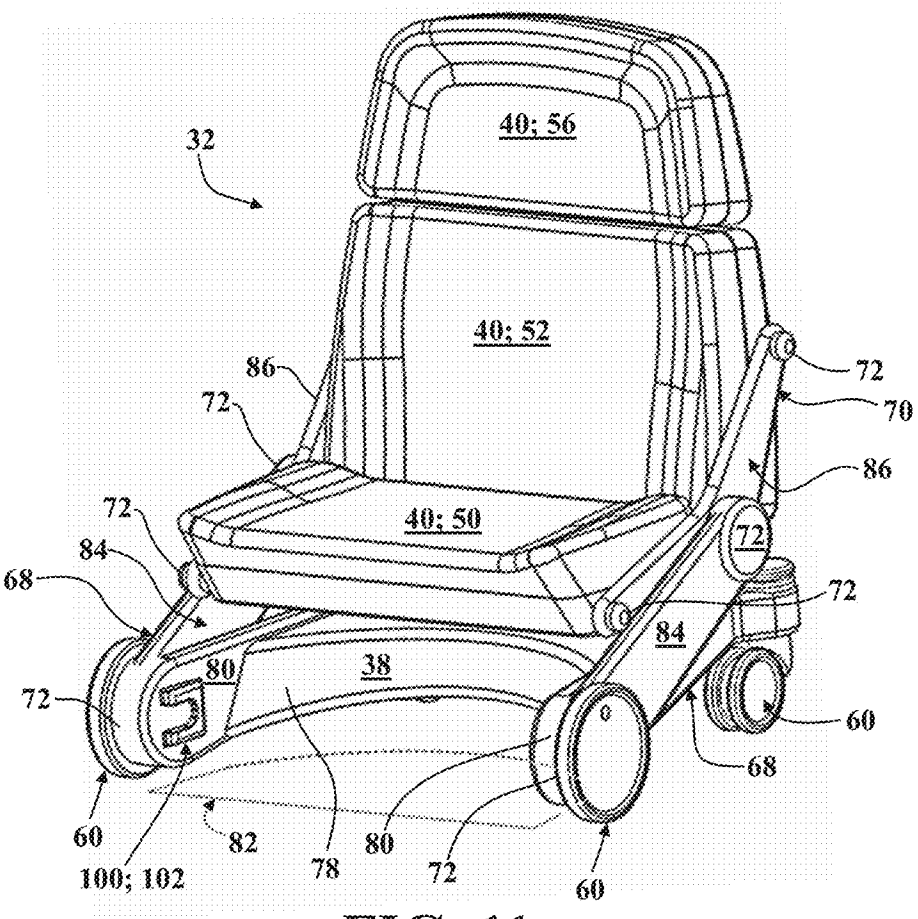
FIG. 11 is a perspective view of the primary patient support module arranged as depicted in FIGS. 4 and 9, the primary patient support module shown having a receiver.

As is best shown in FIG. 10, the primary base 38 of the primary patient support module 32 has a generally U-shaped profile defined by a primary frame 78 and primary legs 80 extending from the primary frame 78. Here, the primary patient support module 32 is configured to define a floor access region, generally indicated at 82, which is arranged to promote patient ambulation away from the primary patient support module 32 when the modular patient support system 30 is in the undocked configuration 30B (see also FIG. 11). The floor access region 82 is positioned so as to allow the seated patient to place their feet on the floor 36 when the primary support deck 40 is arranged in one of the chair configurations 66, and configured to uninterrupted space to allow for movement of the patient's feet.

In one embodiment, the primary legs 80 define at least a portion of the floor access region 82. However, it will be appreciated that the floor access region 82 is an imaginary boundary generally defined by the shape of the primary base 38 of the primary patient support module 32 which is projected on the floor 36 when viewed from above (see FIG. 10). In one embodiment, the floor access region 82 is arranged at least partially beneath the seat section 50 of the primary patient support module 32 when the modular patient support system 30 is in the docked configuration 30A, and is also arranged at least partially beneath the foot section 54 of the secondary patient support module 32 when the modular patient support system 30 is in the docked configuration 30A. Thus, a nesting arrangement is provided between the primary patient support module 32 and the secondary patient support module 34 such that a portion of the secondary base 44 may be positioned in the floor access region 82 when the modular patient support system 30 is in the docked configuration 30A. Moreover, this arrangement prevents any portion of the secondary patient support module 34 from inhibiting access to the floor access region 82 when the modular patient support system 30 operates in the undocked configuration 30B, as is described in greater detail below.

In the representative embodiment illustrated herein, the primary intermediate frame 68 is realized as a pair of primary intermediate frame members 84, and the primary positioning frame 70 is similarly realized as a pair of primary positioning frame members 86. Here, the primary positioning frame members 86 each have a generally V-shaped profile, and the primary intermediate frame members 84 each have a generally I-shaped profile. The primary intermediate frame members 84 are pivotally coupled to the respective primary legs 80 of the primary base 38, and are also pivotally coupled to the respective primary positioning frame members 86. Similarly, the seat section 50 and the back section 52 of the primary support deck 40 are each pivotally coupled to the primary positioning frame members 86. This arrangement further contributes to uninhibited access to the floor access region 82 when the modular patient support system 30 operates in the undocked configuration 30B. However, those having ordinary skill in the art will appreciate that the primary patient support module 32 could employ any suitable number of components of any suitable type, configuration, or arrangement sufficient to promote movement of the primary support deck 40 relative to the primary base 38.

As noted above, the modular patient support system 30 is configured to promote patient ambulation across the floor 36 away from the primary patient support module 32 when in the undocked configuration 30B and with the primary support deck 40 arranged in a chair configuration 66 in which the seat section 50 is positioned vertically near the floor 36 so as to position the patient's feet on the floor 36 within or adjacent to the floor access region 82. In one embodiment, the modular patient support system 30 is further configured to promote patient ambulation along the floor 36 concurrent with the secondary patient support module 34 away from the primary patient support module 32. To this end, the secondary patient support module 34 may further comprise a grip 88 to support the patient for ambulation (see FIGS. 4, 8, and 9). As will be appreciated from the subsequent description below, the grip 88 may be operatively attached to the secondary support deck 46 and/or to one or more portions of the secondary intermediate frame 74.

The secondary support deck 46 of the secondary patient support module 34 is movable relative to the secondary base 44 when the modular patient support system 30 is in the undocked configuration 30B to facilitate access to the grip 88 which, in turn, is configured to support the patient for ambulation concurrent with the secondary patient support module 34. More specifically, and as is best illustrated by comparing FIGS. 8 and 9, in one embodiment, the secondary support deck 46 is movable to a stowed configuration 90 when the modular patient support system 30 is in the undocked configuration 30B. Similarly, in one embodiment, the grip 88 is arranged for movement relative to the secondary base 44, such as via one or more secondary actuators 76, when the secondary support deck 46 is in the stowed configuration 90 (compare FIG. 8 to FIG. 9). Specifically, the grip 88 is movable from a retracted configuration 88A to a deployed configuration 88B when the secondary support deck 46 is in the stowed configuration 90. It will be appreciated that the grip 88 could move between the retracted configuration 88A and the deployed configuration 88B as the secondary support deck 46 moves to the stowed configuration 90, or could be move subsequent to the support deck 46 arriving at the stowed configuration 90.

Figure 12:
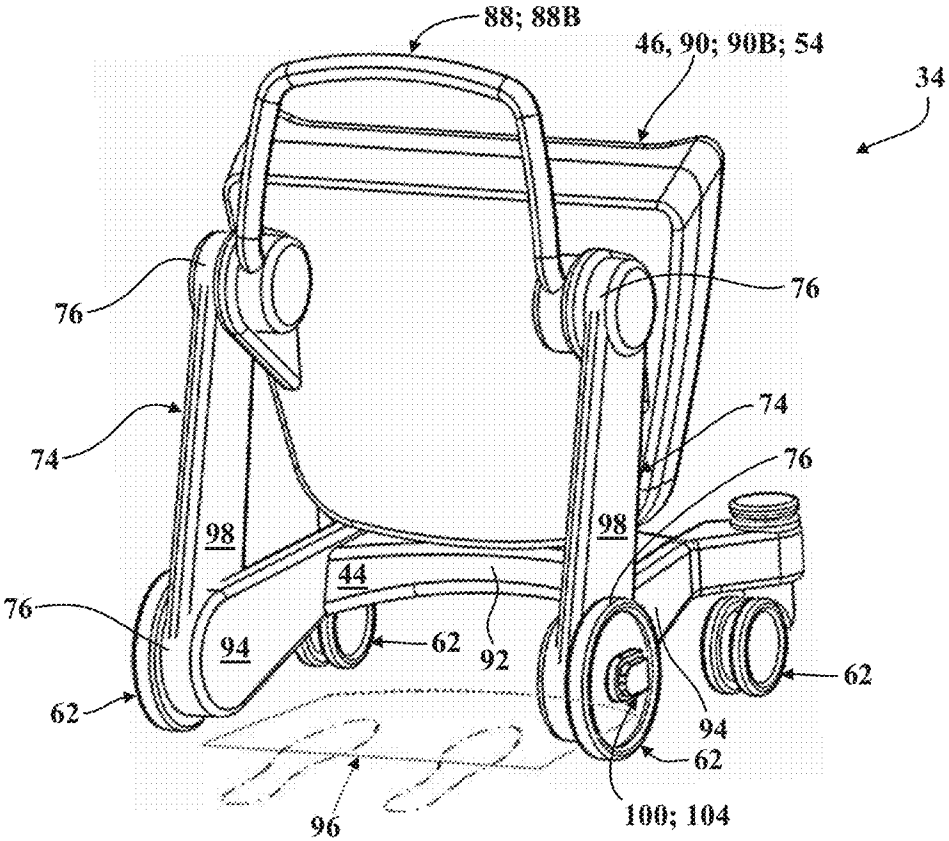
FIG. 12 is a perspective view of the secondary patient support module arranged as depicted in FIGS. 4 and 9, the secondary patient support module shown having a coupler.
Figure 13:
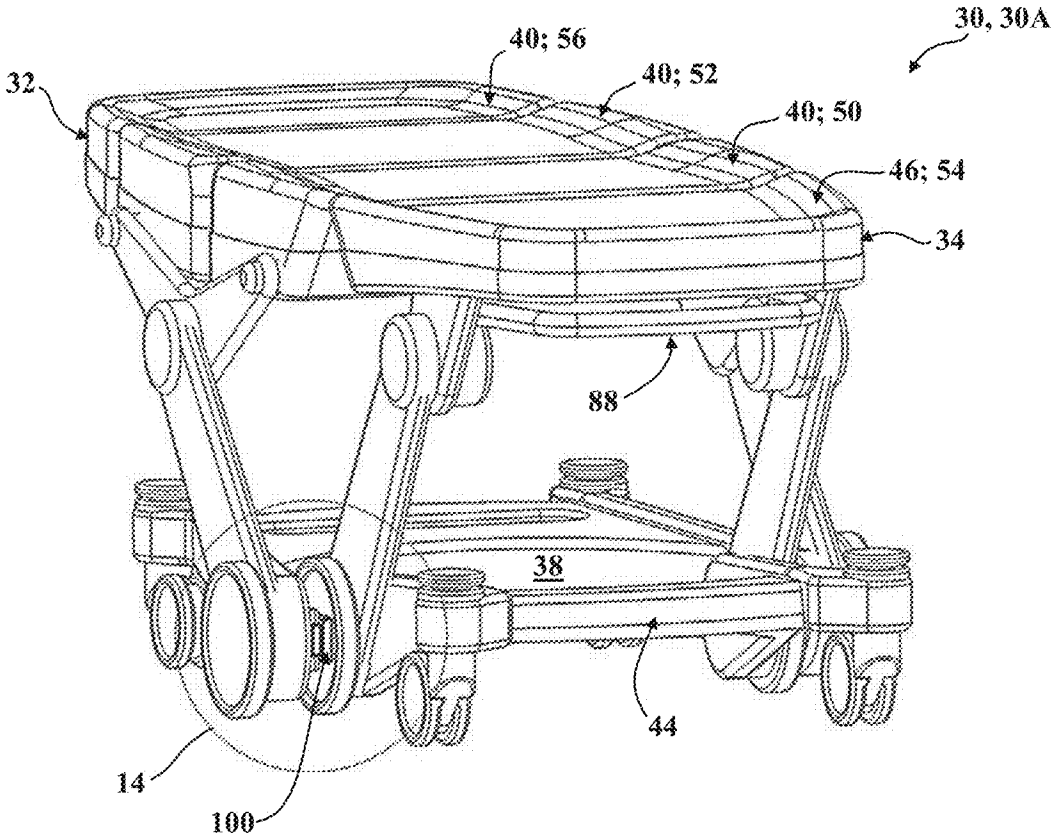
FIG. 13 is a perspective view of the modular patient support system arranged as depicted in FIG. 1, shown with the receiver of the primary patient support module depicted in FIG. 11 engaged with the coupler of the secondary patient support module depicted in FIG. 12.

As is best shown in FIG. 10, the secondary base 44 of the secondary patient support module 34, like the primary base 38 of the primary patient support module 32 described above, also has a generally U-shaped profile. Here, the secondary base 44 is defined by a secondary frame 92 and secondary legs 94 extending from the secondary frame 92. The secondary patient support module 34 is configured to define a walking access region, generally indicated at 96, which is arranged to promote patient ambulation concurrent with the secondary patient support module 34 when the modular patient support system 30 is in the undocked configuration 30B (see also FIG. 12). The walking access region 96 is positioned so as to allow the standing patient to place their feet on the floor 36 and access the grip 88 for support when the secondary support deck 46 is arranged in the stowed configuration 90. The grip 88 has a generally tubular profile and is shaped so as to provide support to patients of different heights and body types. It will be appreciated that the grip 88 can be positioned in a number of different ways, such as at different heights, angles, and the like, to accommodate different applications. Moreover, it will be appreciated that the grip 88 could be extendable/retractable.

In one embodiment, the secondary legs 94 of the secondary base 44 define at least a portion of the walking access region 96. However, it will be appreciated that the walking access region 96, like the floor access region 82 described above, is likewise an imaginary boundary generally defined by the shape of the secondary base 44 of the secondary patient support module 34 which is projected on the floor 36 when viewed from above (see FIG. 10). In one embodiment, the walking access region 96 is arranged at least partially beneath the grip 88 of the secondary patient support module 34 when the modular patient support system 30 is in the undocked configuration 30B (see FIG. 12), and is also arranged at least partially beneath the secondary support deck 46 when the modular patient support system 30 is in the docked configuration 30A. It will be appreciated that this configuration further contributes to the nesting arrangement between the primary patient support module 32 and the secondary patient support module 34 described above. However, because the walking access region 96 can be defined in a number of different ways, those having ordinary skill in the art will appreciate that the grip 88 could be positioned in any suitable orientation or configuration. Specifically, it will be appreciated that all or part of the grip 88 could conceivably be positioned outside of the walking access region 96.

In the representative embodiment illustrated herein, the secondary intermediate frame 74 is realized as a pair of primary intermediate frame members 98 which each have a generally I-shaped profile and which are pivotally coupled to the respective secondary legs 94 of the secondary base 44, and are also pivotally coupled to the secondary support deck 46. This arrangement contributes to uninhibited access to the walking access region 96 when the modular patient support system 30 operates in the undocked configuration 30B with the secondary support deck 46 disposed in the stowed configuration 90, as described above. However, those having ordinary skill in the art will appreciate that the primary patient support module 32 could employ any suitable number of components of any suitable type, configuration, or arrangement sufficient to promote movement of the secondary support deck 46 relative to the secondary base 44.

As noted above, when the modular patient support system 30 operates in the docked configuration 30A, the primary support deck 40 of the primary patient support module 32 and the secondary support deck 46 of the secondary patient support module 34 cooperate to provide support to the patient within the second patient support area 48. Here too in the docked configuration 30A, the primary base 38 of the primary patient support module 32 moves concurrently with the secondary base 44 of the secondary patient support module 34. To this end, in one embodiment the modular patient support system 30 further comprises an interface, generally indicated at 100, arranged between the primary patient support module 32 and the secondary patient support module 34, for operating the modular patient support system 30 between the docked configuration 30A and the undocked configuration 30B. As will be appreciated from the subsequent description below, the interface 100 can be realized in a number of different ways depending on application requirements.

In the representative embodiment depicted herein, and as is best shown in FIGS. 13-16, the interface 100 of the modular patient support system 30 is defined by interaction between a coupler, generally indicated at 102, and a receiver, generally indicated at 104. Here, the coupler 102 is operatively attached to the primary patient support module 32 on one of the primary legs 80 and extends laterally inwardly towards the other primary leg 80, and the receiver 104 is operatively attached to the secondary patient support module 34 on one of the secondary legs 94 and extends laterally outwardly away from the other secondary leg 94. Here, the coupler 102 and the receiver 104 are shaped such that the coupler 102 secures the receiver 104 when the modular patient support system 30 operates in the docked configuration 30A so as to link the secondary patient support module 34 with the primary patient support module 32 for concurrent movement along the floor 36.

While the modular patient support system 30 depicted herein employs a single coupler 102 and a single receiver 104, those having ordinary skill in the art will appreciate that any suitable number of couplers 102 and/or receivers 104 could be operatively attached to any suitable portion of the primary patient support module 32 and/or the secondary patient support module 34. Specifically, it will be appreciated that the arrangement of the coupler 102 and the receiver 104 could be interchanged, such as with the receiver 104 operatively attached to the primary patient support module 32 and the coupler 102 operatively attached to the secondary patient support module 34.

Figure 14:
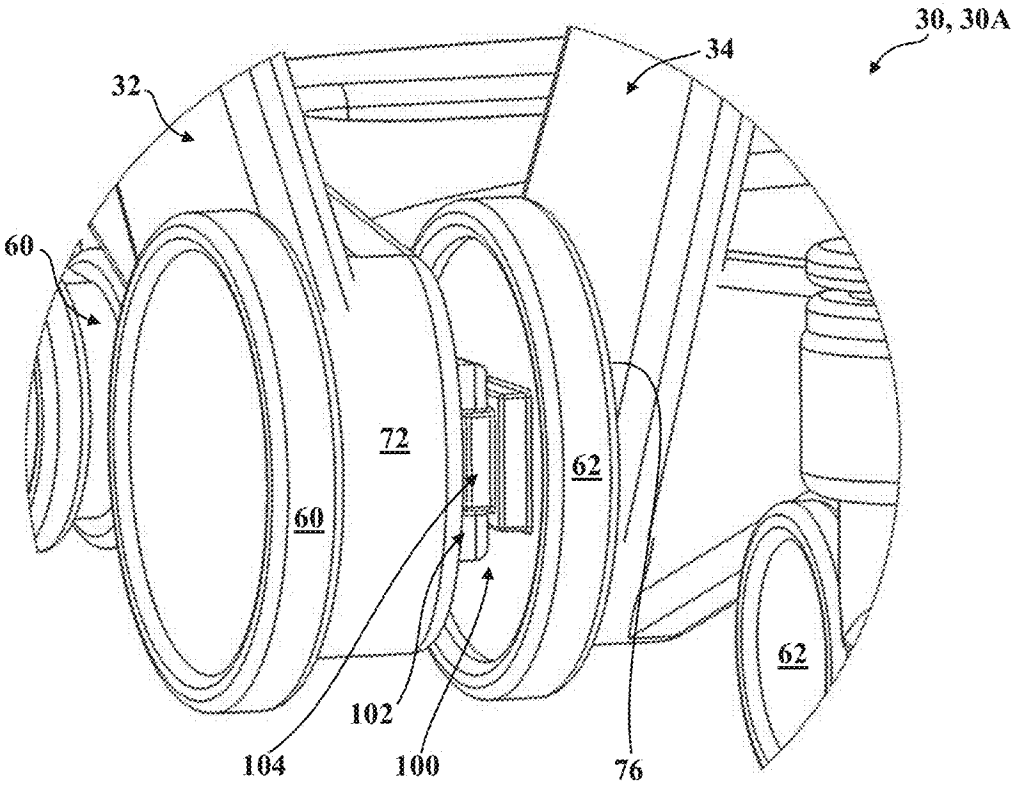
FIG. 14 is an enlarged partial perspective view of the modular patient support system arranged as depicted in FIG. 1 taken from indicia 14 of FIG. 13, showing additional detail of the coupler and receiver.
Figure 15:
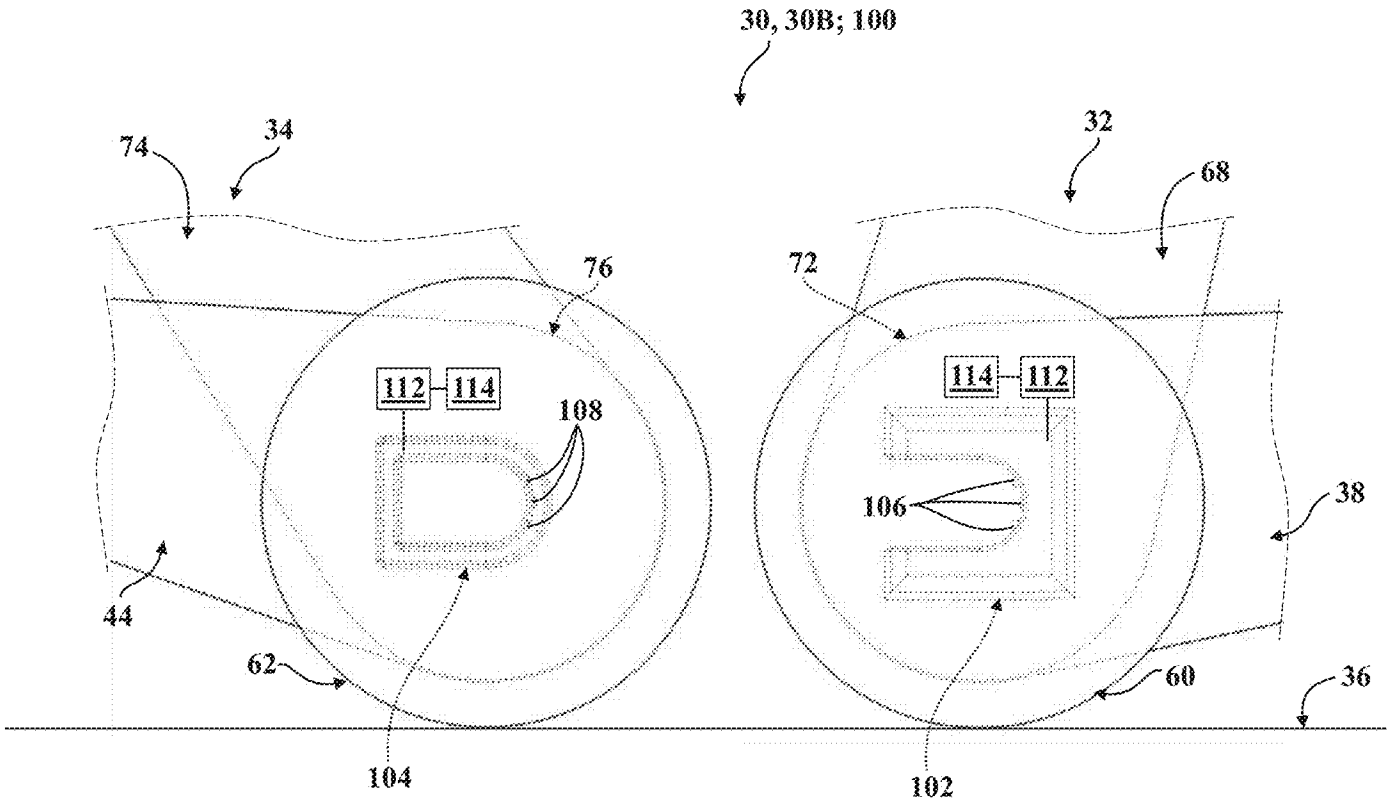
FIG. 15 is a partial left-side schematic view of the primary patient support module of FIG. 11 spaced from the secondary patient support module of FIG. 12, with the undocked receiver and coupler depicted in phantom and not engaged with one another.
Figure 16:
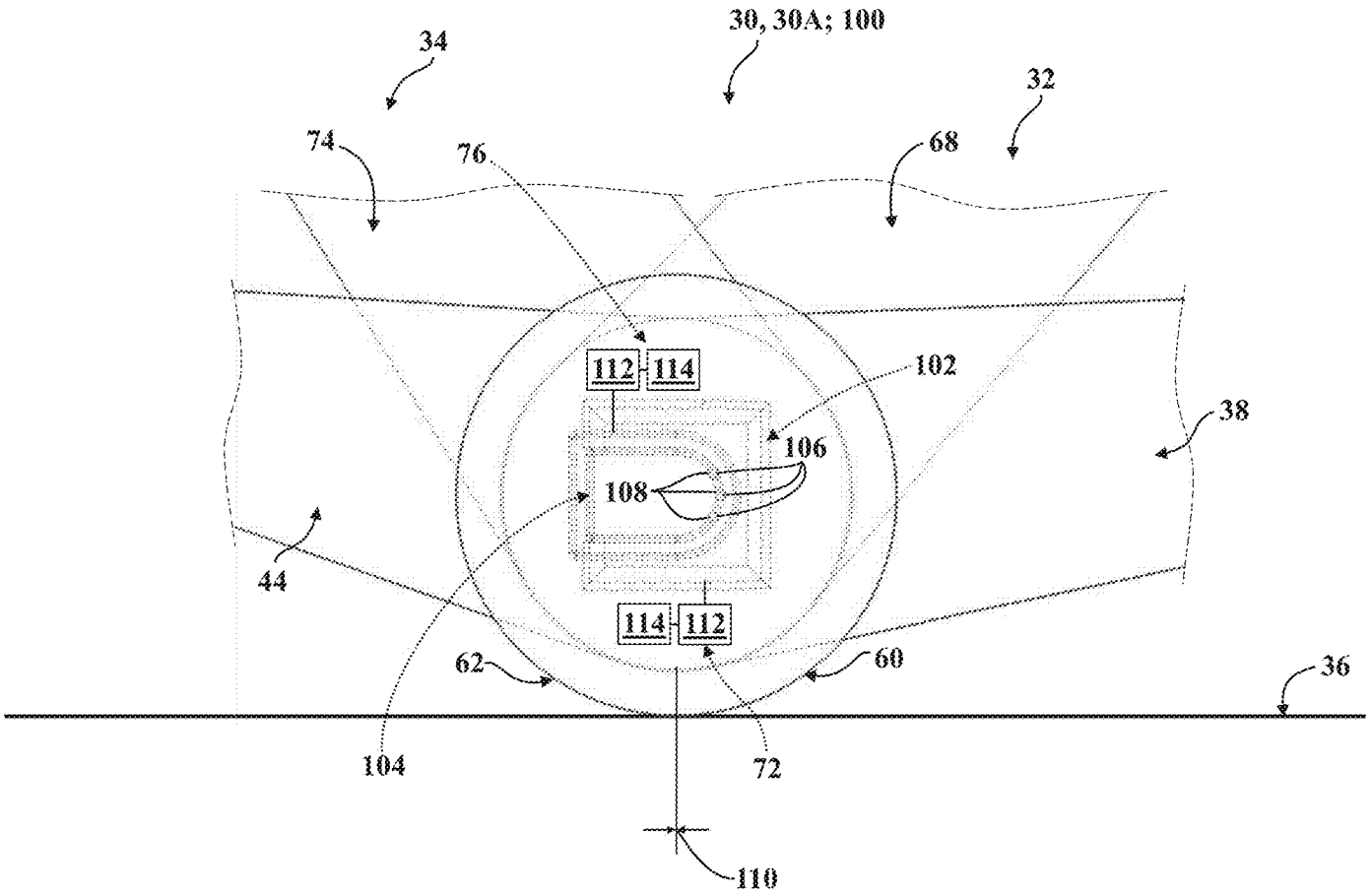
FIG. 16 is another partial left-side schematic view of the primary patient support module and the secondary patient support module of FIG. 15, with the receiver and coupler depicted in phantom and engaged with one another.

As is best shown in FIGS. 14-16, the coupler 102 and the receiver 104 are shaped complimentarily to one another so as to provide a physical link between the primary patient support apparatus 32 and the secondary patient support apparatus 34 when the modular patient support system 30 operates in the docked configuration 30A. In one embodiment, the coupler 102 includes a coupler connector 106 and the receiver 104 includes a receiver connector 108, with the coupler connector 106 and the receiver connector 108 abutting one another to facilitate electrical communication between the primary patient support module 32 and the secondary patient support module 34 when the modular patient support system 30 operates in the docked configuration 30A (see FIG. 16). In one embodiment, the coupler connector 106 and the receiver connector 108 are configured to communicate at least one of electrical power and electrical control signals between the primary patient support module 32 and the secondary patient support module 34 when the modular patient support system 30 operates in the docked configuration 30A. It will be appreciated that communication across the coupler 102 and the receiver 104 could be of any suitable type or configuration, including direct electrical contact, inductive electrical communication, wireless electrical communication, and the like.

In the representative embodiment illustrated in FIGS. 15-16, the coupler 102 includes three coupler connectors 106 arranged to abut three correspondingly arranged receiver connectors 108 of the receiver 104. However, it will be appreciated that any suitable number of coupler connectors 106 and/or receiver connectors 108 could be utilized. Moreover, it will be appreciated that the coupler 102, the receiver 104, the coupler connectors 106, and the receiver connectors 108 are depicted generically and, thus, could be of any suitable size, shape, arrangement, and/or configuration.

In one embodiment, the interface 100 is configured to allow movement of the secondary support deck 46 with respect to the primary support deck 40 when the modular patient support system 30 operates in the docked configuration 30A (compare FIGS. 5 and 6). More specifically, in one embodiment, the interface 100 maintains a predetermined distance 110 defined between the primary support deck 40 and the secondary support deck 46 when the modular patient support system 30 operates in the docked configuration 30A so as to facilitate relative movement between the primary support deck 40 and the secondary support deck 46 between the bed configurations 64A, 64B described above. As is best depicted in FIG. 6, the predetermined distance 110 in the representative embodiment illustrated herein is zero to illustrate the arrangement of the patient support modules 32, 34 when in the docked configuration 30A. Thus, it will be appreciated that the predetermined distance 110 may be defined differently than the gap 49 described above. Specifically, predetermined distance 110 may remain at zero when the modular patient support system 30 is in the docked configuration 30A and, at the same time, the gap 49 may change as the modular patient support system 30 moves between the patient support configurations, as noted above.

It will be appreciated that the interface 100 can be configured to link the primary patient support module 32 with the secondary patient support module 34 via the physical interaction between the coupler 102 and the receiver 104. To this end, the complimentary shape of the coupler 102 and the receiver 104 ensures that the secondary base 44 is properly aligned with the primary base 38, such as with the driven primary wheels 60 supporting the primary base 38 being aligned concentrically with the driven secondary wheels 62 supporting the secondary base 44 such that the predetermined distance 110 here is zero (see FIGS. 5 and 16). However, it will be appreciated that alignment between the primary patient support module 32 and the secondary patient support module 34 can be achieved in the docked configuration 30A in a number of different ways.

Moreover, those having ordinary skill in the art will appreciate that the alignment and linking afforded by the interface 100 could be achieved without the use of a discrete coupler 102 and receiver 104 to provide a physical connection between the primary patient support module 32 and the secondary patient support module 34 in the docked configuration 30A. By way of non-limiting example, one or more sensors arranged on the primary patient support module 32 and/or the secondary patient support module 34 could be employed to maintain a relative position therebetween without the use of physical components to link the secondary base 44 to the primary base 38 for concurrent movement along the floor 36. By way of non-limiting example, the driven primary wheels 60 of the primary patient support module 32 and the driven secondary wheels 62 of the secondary patient support module 34 could be configured to follow each other or otherwise maintain alignment using positional feedback from the sensors. Similarly, those having ordinary skill in the art will appreciate that the modular patient support system 30 could employ non-contact interaction between the patient support modules 32, 34 when in the docked configuration 30A to facilitate concurrent or coordinated movement, such as via magnetic or electromagnetic coupling.

Referring now to FIGS. 5-9 and 15-17, in one embodiment, the modular patient support system 30 further comprises a controller, depicted schematically at 112, and a battery, depicted schematically at 114 (see FIGS. 15-16). As is described in greater detail below, the controller 112 is disposed in electrical communication with the primary actuator 72 and the secondary actuator 76, and may be powered by the battery 114. The controller 112 is configured to selectively drive the primary actuator 72 and the secondary actuator 76 so as to cause independent movement of the primary support deck 40 and the secondary support deck 46.

In one embodiment, the controller 112 is configured to drive the primary actuator 72 and the secondary actuator 76 to cause coordinated movement of the primary support deck 40 and the secondary support deck 46 relative to each other and to the primary base 38 and/or the secondary base 44 (compare FIGS. 5 and 6). To this end, the controller 112 may be configured to perform compound movements that, when a patient is supported by the modular patient support system 30, causes multiple portions of the patient's body to be moved in a coordinated manner. Thus, the controller 112 is capable of moving the modular patient support system 30 between different bed configurations 64 and chair configurations 66, each defined by the relative orientation of the components of the primary support deck 40 and/or the secondary support deck 46, as noted above.

In one embodiment, the controller 112 is capable of changing the angular orientation of various portions of the patient's body simultaneously, such as the patient's head, back, thighs, calves, and/or feet. In addition, the controller 112 is configured to control a rate of operation at which the primary actuators 72 and the secondary actuators 76 cooperate to move between bed configurations 64 and/or chair configurations 66. As noted above, the primary actuators 72 and the secondary actuators 76 are generically-depicted as rotary actuators. However, it will be appreciated that one or more components of the modular patient support system 30 could employ other types of actuators, linkages, or other mechanisms which cooperate with the controller 112 to facilitate coordinated movement. By way of non-limiting example, one or more sections of the primary support deck 40 and/or the secondary support deck 46 could employ linear actuators arranged to "slide" sections with respect to each other in order to facilitate relative positioning of the sections during coordinated movement. Here, one or more of the sections 50, 52, 54, 56 could be configured to translate along it's respective support structure or frame without necessarily rotating or pivoting, such as to ensure that relative spacing between certain sections 50, 52, 54, 56 is maintained as the modular patient support system 30 moves between different configurations or orientations, as noted above. Similarly, this configuration contributes to stability of the modular patient support system 30 in use by advantageously positioning the center of gravity of certain components relative to one or more of the bases 38, 44 as the patient's body is moved with respect to the floor 36.

Figure 8:
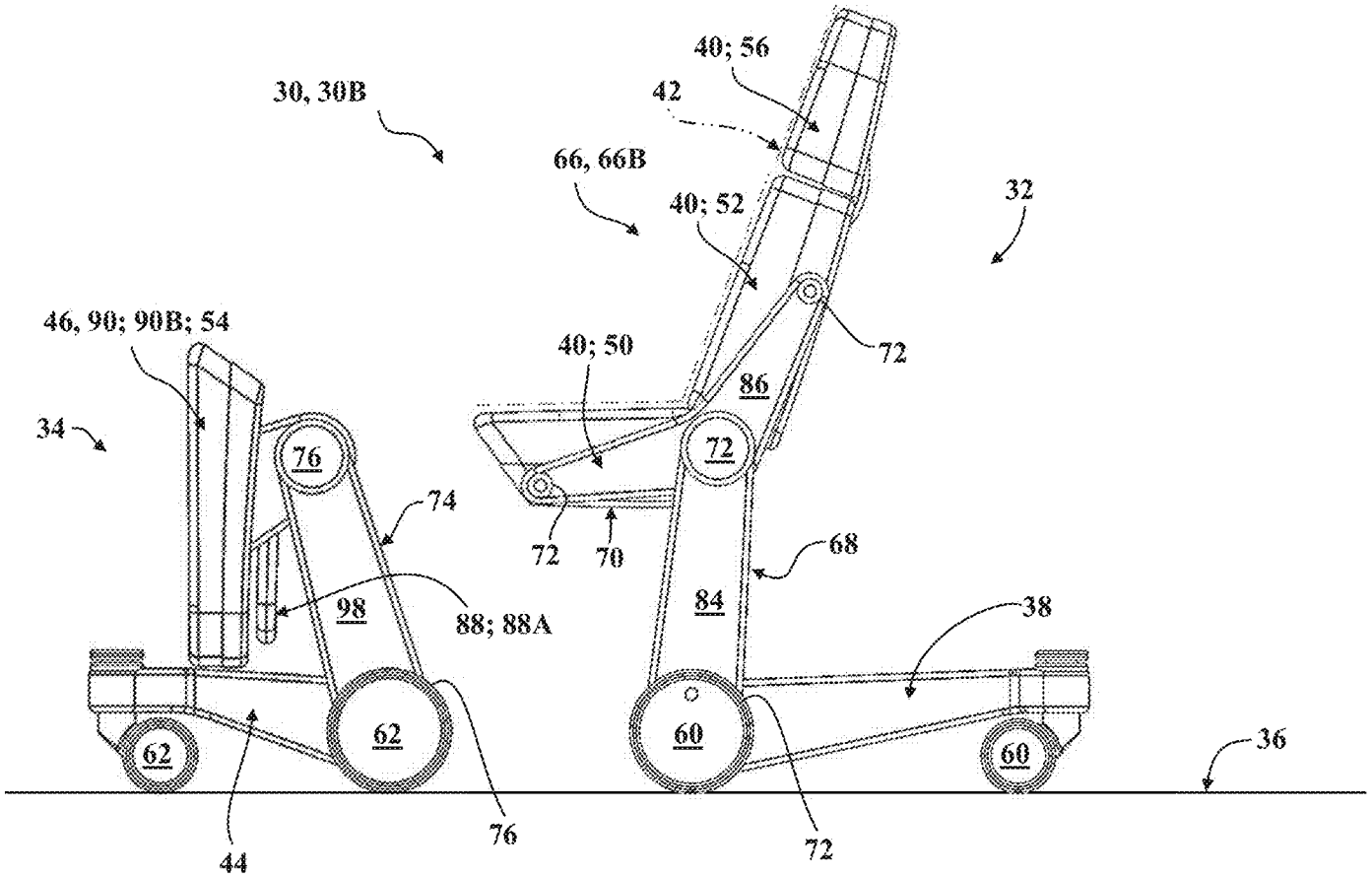
FIG. 8 is a left-side view of the modular patient support system arranged as depicted in FIG. 3.
Figure 9:
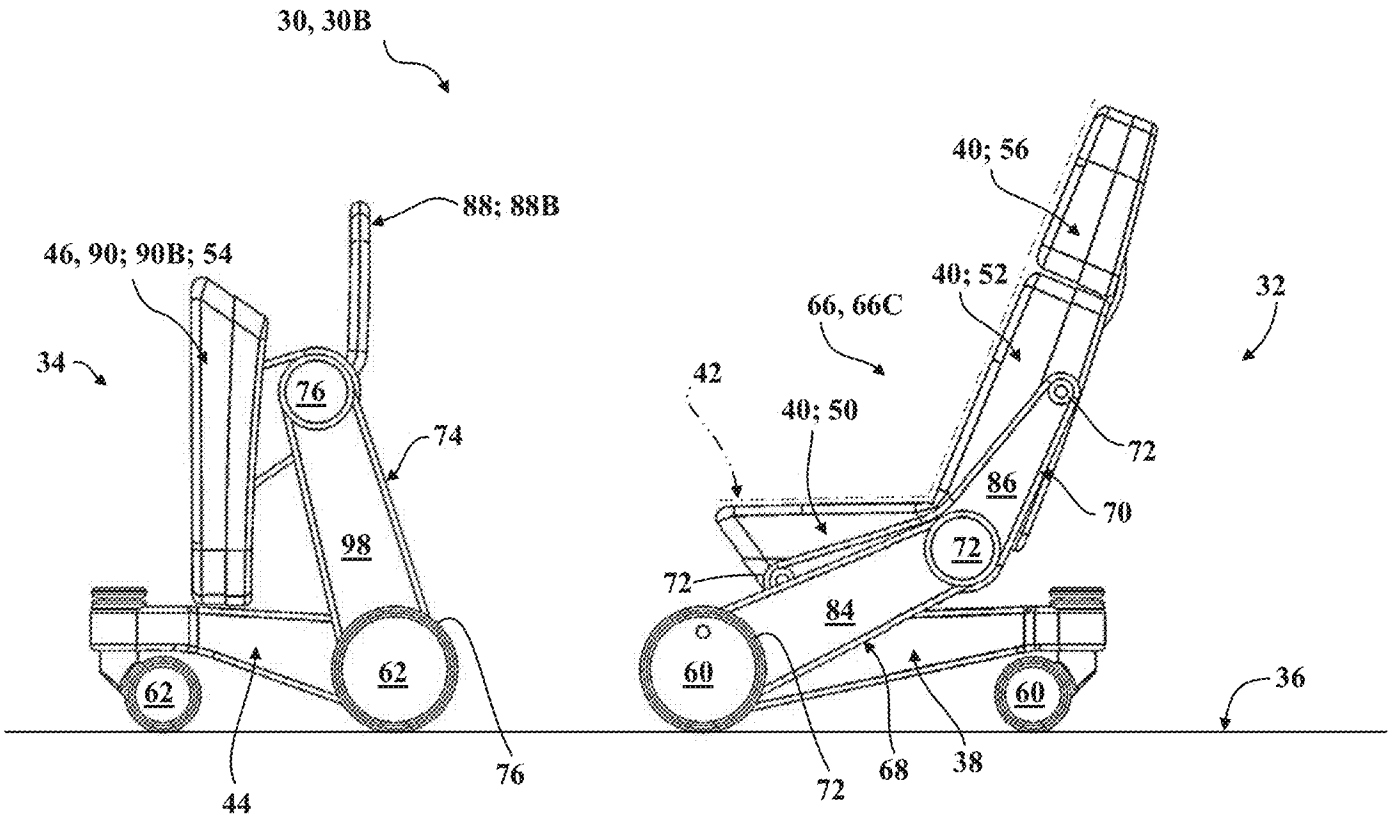
FIG. 9 is a left-side view of the modular patient support system arranged as depicted in FIG. 4.

In certain embodiments, the controller 112 may be configured to drive the primary actuator 72 and the secondary actuator 76 to cause generally vertical movement of the primary support deck 40 and the secondary support deck 46 with respect to the floor 36 (compare FIGS. 8 and 9). It will be appreciated that the controller 112 may be realized as a discrete component arranged on the primary patient support module 32 and/or on the secondary patient support module 34. By way of non-limiting example, and as is shown in FIGS. 15 and 16, controllers 112 and batteries 114 could be provided on each of the primary patient support module 32 and the secondary patient support module 34 and could communicate with each other across the interface 100, as described above. It will be appreciated that the controllers 112, batteries 114, and the electrical communication therebetween is depicted schematically and generically in FIGS. 15 and 16. Moreover, it will be appreciated that the controller 112 could be used to control one or more driven primary wheels 60 of the primary patient support module 32 and/or one or more driven secondary wheels 62 of the secondary patient support module 34, as noted above. Furthermore, it will be appreciated that the controller 112 and/or the battery 114 could be realized in any suitable way and could be of any suitable type, configuration, or arrangement. By way of non-limiting example, the controller 112 could be realized by one or more discrete Central Processing Units (CPU), Integrated Circuits (IC), relays, transistors, and the like.

In operation, when the modular patient support system 30 operates in the docked configuration 30A, the primary support deck 40 of the primary patient support module 32 and the secondary support deck 46 of the secondary patient support module 34 are movable between the bed configurations 64 and cooperate to define the second patient support area 48, as noted above. Thus, in the docked configuration 30A, the modular patient support system 30 serves as a bed to support the patient's entire body within the second patient support area 48. Here, the sections of the primary support deck 40 and the secondary support deck 46 can be moved with respect to each other so as to adjust the shape of the second patient support area 48 to promote patient comfort. By way of example, the seat section 50, the back section 52, and the foot section 54 can be positioned generally parallel to each other to provide the patient with a generally flat surface to lay upon in a first bed configuration 64A (see FIGS. 1 and 5), can be oriented so as to allows the patient to lay upright in a second bed configuration 64B (see FIGS. 2 and 6), and/or can be positioned in any other suitable bed configuration 64. Here too, the primary support deck 40 and/or the secondary support deck 46 can be moved so as to bring the patient vertically closer to or further away from the floor 36. By way of non-limiting example, one or more of the actuators 72, 76 can operate at the same time in such a way that one or more of the frame members 84, 86, 98 move simultaneously, in the same direction, at the same rate, and the like.

When the modular patient support system 30 operates in the undocked configuration 30B, the secondary patient support module 34 can be moved away from the primary patient support module 32 (compare FIG. 6 with FIG. 7) such that the patient is supported by the primary support deck 46 and the secondary support deck 46 no longer provides support to the patient. It will be appreciated that the controller 112 could be configured to move the modular patient support system 30 to the undocked configuration 30B subsequent to or concurrently with bringing the primary patient support module 32 into a chair configuration, as noted above. Here, the patient is seated and is supported within the first patient support area 42 defined by the primary support deck 40 arranged in and movable between various chair configurations 66. Specifically, the primary patient support module 32 can move from a first chair configuration 66A (see FIG. 7) defined by the orientation of the primary support deck 40 in the second bed configuration 64B (compare FIG. 7 with FIG. 6), to a second chair configuration 66B (see FIG. 8) defined with the seat section 50 of the primary support deck 40 arranged substantially parallel with the floor 36, to a third chair configuration 66C (see FIG. 9) defined with the seat section 50 arranged vertically closer to the floor 36 than in the second chair configuration 66B (compare FIG. 9 with FIG. 8), and/or to any other suitable chair configuration 66.

Figure 7:
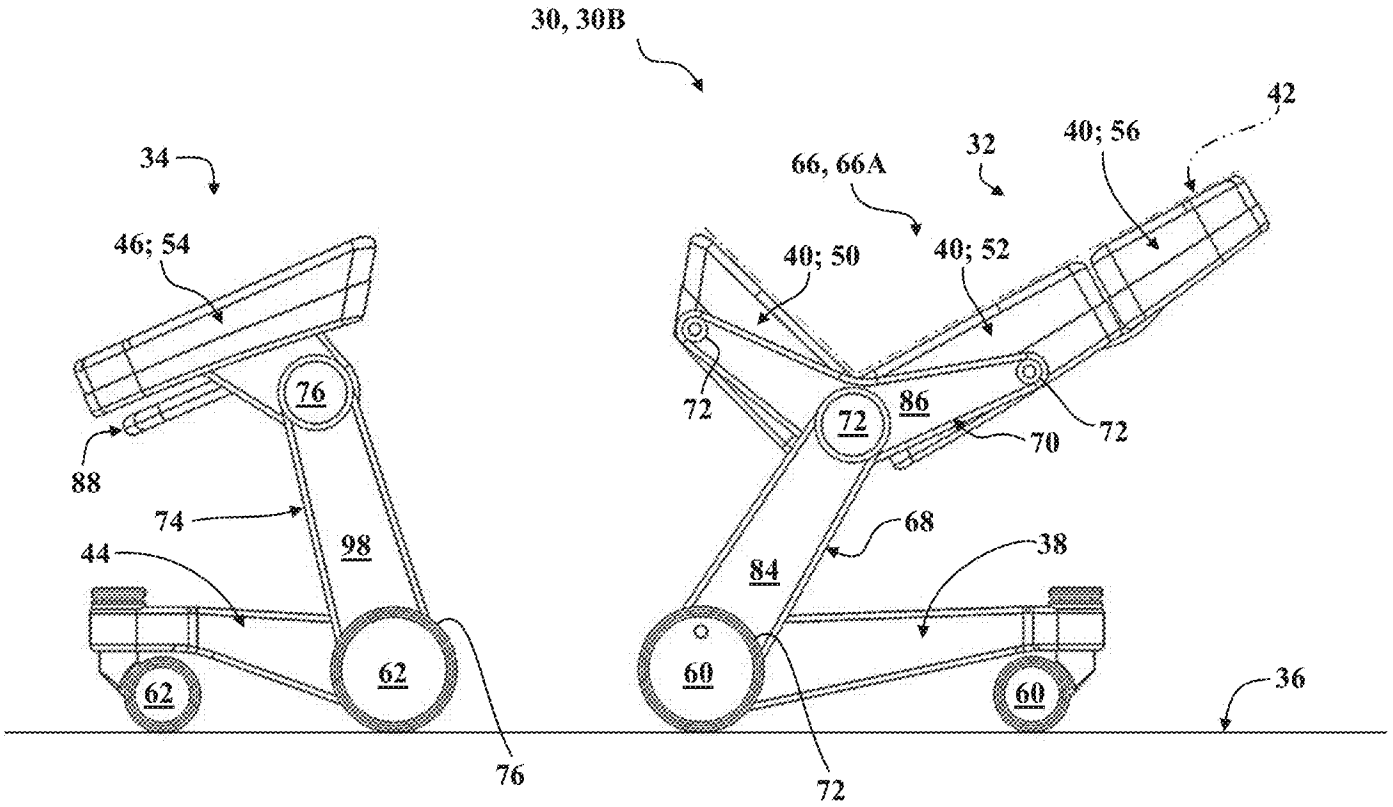
FIG. 7 is another left-side view of the modular patient support system of FIG. 1 shown in the undocked configuration with the secondary patient support module spaced from the primary patient support module.

Here too in the undocked configuration 30B, the foot section 54 of the secondary support deck 46 of the secondary patient support module 34 can move from the relative position defined in the second bed configuration 64B (see FIGS. 6 and 7) towards the stowed configuration 90B (see FIG. 8; compare with FIG. 7). Next, the primary patient support module 32 can move from the second chair configuration 66B (see FIG. 8) towards a third chair configuration 66C (see FIG. 9) so as to position the patient vertically closer to the floor 36 (compare FIG. 9 with FIG. 8), and the grip 88 of the secondary patient support module 34 can then be positioned for use by the patient, i.e., when in the deployed configuration 88B, as noted above. Thus, the seated patient supported in the third chair configuration 66C can place their feet on the floor 36 within or adjacent to the floor access region 82 in preparation for ambulation (see also FIG. 11). Here, because the secondary patient support module 34 is spaced from the primary patient support module 32, no portion of the secondary patient support module 34 inhibits patient access to the floor access region 82. Once the patient has positioned their feet on the floor within or adjacent to the floor access region 82, the patient can subsequently stand to exit the primary patient support module 32 by coming out of contact with the first patient support area 42. The patient can then grasp the grip 88 of the secondary patient support module 34 as a standing aid while positioning their feet within or nearby the walking access region 96. Next, the patient can use the secondary patient support module 34 as a "walker" to ambulate away from the primary patient support module 32. Here, those having ordinary skill in the art will appreciate that the second patient support module 34 could be configured in a number of different ways sufficient to move or be moved away from the primary patient support module 32 along the floor 36 when the modular patient support system 30 is in the undocked configuration 30B. By way of non-limiting example, the second patient support module 34 could employ, serve as, or otherwise be realized as a storage unit, a monitor or equipment stand, an IV pole, a pain pump stand, an oxygen tank storage space, a table top space, a workstation, a seat or stool, and the like.

In this way, the modular patient support system 30 affords significant advantages for promoting patient mobility and ambulation while, at the same time, reducing the risk of patient injury while exiting patient support apparatuses. Specifically, it will be appreciated that the nesting arrangement between the primary patient support module 32 and the secondary patient support module 34 minimizes the overall size and footprint of the modular patient support system 30 when in the bed configuration 64. Similarly, because the secondary patient support module 34 can be moved away from the primary patient support module 32 in the undocked configuration 30B, no portion of the secondary patient support module 34 blocks or otherwise inhibits access to the floor under the patient's feet, which allows the primary patient support module 32 arranged in the chair configuration 66 to advantageously position the seated patient such that their feet can touch the floor 36 within or adjacent to the floor access region 82 to stand. Moreover, the secondary patient support module 32 further promotes patient ambulation by allowing the patient access to the grip 88 in the deployed configuration 88A when the secondary support deck 46 is in the stowed configuration 90, thereby allowing the patient to ambulate concurrently with the secondary patient support module 34 along the floor 36.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A modular patient support system for use in ambulating a patient across a floor, said modular patient support system comprising:

a primary patient support module comprising a primary base and a primary support deck arranged for movement relative to said primary base, said primary support deck defining a contiguous first patient support area; and a secondary patient support module comprising a secondary base adapted for movement along the floor relative to said primary base and a secondary support deck arranged for movement relative to said secondary base;

where said modular patient support system is operable between:

a docked configuration where said secondary support deck cooperates with said primary support deck to define a contiguous second patient support area larger than said contiguous first patient support area, said primary support deck and said secondary support deck being movable relative to each other to support the patient in a plurality of different bed configurations including a knee brake configuration defined with said secondary support deck arranged at a reflex angle relative to an adjacent section of said primary support deck, and an undocked configuration where said secondary patient support module is spaced apart from said primary patient support module to facilitate patient egress from said primary patient support module and ambulation concurrent with said secondary patient support module across the floor away from said primary patient support module, said secondary support deck being movable relative to said secondary base in said undocked configuration to promote patient ambulation concurrent with said secondary patient support module.

2. The modular patient support system as set forth in claim 1, further comprising an interface arranged between said primary patient support module and said secondary patient support module for operating said modular patient support system between said docked configuration and said undocked configuration.

3. The modular patient support system as set forth in claim 2, further comprising a coupler operatively attached to one of said primary patient support module and said secondary patient support module, and a receiver operatively attached to the other of said primary patient support module and said secondary patient support module, said coupler securing said receiver when said modular patient support system operates in said docked configuration to link said secondary patient support module with said primary patient support module for concurrent movement along the floor, wherein interaction of said coupler and said receiver define said interface.

4. The modular patient support system as set forth in claim 3, wherein said coupler includes a coupler connector and said receiver includes a receiver connector, with said coupler connector and said receiver connector abutting one another to facilitate electrical communication between said primary patient support module and said secondary patient support module when said modular patient support system operates in said docked configuration.

5. The modular patient support system as set forth in claim 2, wherein said interface is configured to allow movement of said secondary support deck with respect to said primary support deck when said modular patient support system operates in said docked configuration.

6. The modular patient support system as set forth in claim 2, wherein said interface maintains a predetermined distance defined between said primary support deck and said secondary support deck when said modular patient support system operates in said docked configuration to facilitate relative movement between said primary support deck and said secondary support deck.

7. The modular patient support system as set forth in claim 1, wherein said primary patient support module further comprises a primary actuator arranged to move said primary support deck relative to said primary base.

8. The modular patient support system as set forth in claim 7, wherein said secondary patient support module further comprises a secondary actuator arranged to move said secondary support deck relative to said secondary base.

9. The modular patient support system as set forth in claim 8, further comprising a controller disposed in communication with said primary actuator and with said secondary actuator, wherein said controller is configured to selectively drive said primary actuator and said secondary actuator to cause independent movement of said primary support deck and said secondary support deck.

10. The modular patient support system as set forth in claim 9, wherein said controller is configured to drive said primary actuator and said secondary actuator to cause coordinated movement of said primary support deck and said secondary support deck relative to each other and to said primary base.

11. The modular patient support system as set forth in claim 1, wherein said primary support deck comprises a seat section and a back section being arranged for movement relative to each other and to said primary base, and said primary support deck is movable into a chair configuration defined with said back section arranged at an obtuse angle relative to said seat section when said modular patient support system is in said undocked configuration to maintain support of the patient in said chair configuration as said modular patient support system moves from said docked configuration to said undocked configuration.

12. The modular patient support system as set forth in claim 1, wherein said primary support deck comprises a seat section and a back section arranged for movement relative to each other and to said primary base; and wherein said primary support deck is configured to support the patient with said back section arranged at an obtuse angle relative to said seat section when said modular patient support system operates in said docked configuration, and to maintain support of the patient with said back section arranged at said obtuse angle relative to said seat section as said modular patient support system moves from said docked configuration to said undocked configuration.

13. The modular patient support system as set forth in claim 1, wherein said secondary support deck extends longitudinally between a distal end and a proximal end, said proximal end being arranged adjacent to said primary support deck in said docked configuration; and wherein movement of said secondary support deck in said undocked configuration moves said proximal end of said secondary support deck longitudinally relative to said secondary base to present a walking access region defined adjacent to said secondary base and arranged to promote patient ambulation concurrent with said secondary patient support module.

14. A modular patient support system for use in ambulating a patient across a floor, said modular patient support system comprising:

a primary patient support module comprising a primary base, a seat section, and a back section, said seat section and said back section being arranged for movement relative to each other and to said primary base, said seat section and said back section defining a contiguous first patient support area; and a secondary patient support module comprising a secondary base and a foot section, said foot section being arranged for movement relative to said secondary base;

where said modular patient support system is operable between:

a docked configuration where said secondary base moves along the floor concurrently with said primary base and where said foot section cooperates with said seat section and said back section to define a contiguous second patient support area, said foot section and said back section being movable relative to each other and to said seat section in said docked configuration to support the patient in a plurality of different bed configurations including a knee brake configuration defined with said foot section arranged at a reflex angle relative to said seat section, and an undocked configuration where said secondary patient support module is spaced apart from said primary patient support module to facilitate patient egress from said primary patient support module and ambulation concurrent with said secondary patient support module across the floor away from said primary patient support module, said foot section being movable relative to said secondary base in said undocked configuration to promote patient ambulation concurrent with said secondary patient support module.

15. The modular patient support system as set forth in claim 14, wherein said seat section and said back section of said primary patient support module are movable between chair configurations when said modular patient support system is in said undocked configuration, with each of said seat section and said back section being arranged for at least partially supporting the patient in said chair configurations.

16. The modular patient support system as set forth in claim 14, wherein said primary patient support module further comprises a primary intermediate frame coupled to said primary base and to said seat section and said back section to allow movement of said seat section and said back section relative to said primary base; and wherein said primary patient support module further comprises a primary positioning frame interposed between said primary intermediate frame and said seat section and said back section to allow movement of said seat section and said back section relative to each other and to said primary intermediate frame.

17. The modular patient support system as set forth in claim 14, wherein said primary patient support module is configured to support the patient with said back section arranged at an obtuse angle relative to said seat section when said modular patient support system operates in said docked configuration, and to maintain support of the patient with said back section arranged at said obtuse angle relative to said seat section as said modular patient support system moves from said docked configuration to said undocked configuration.

18. The modular patient support system as set forth in claim 14, wherein said foot section extends longitudinally between a distal end and a proximal end, said proximal end being arranged adjacent to said seat section in said docked configuration; and wherein movement of said foot section in said undocked configuration moves said proximal end of said foot section longitudinally relative to said secondary base to present a walking access region defined adjacent to said secondary base and arranged to promote patient ambulation concurrent with said secondary patient support module.

19. A modular patient support system for use in ambulating a patient across a floor, said modular patient support system comprising:

a primary patient support module comprising a primary base and a primary support deck arranged for movement relative to said primary base, said primary support deck defining a contiguous first patient support area; and a secondary patient support module comprising a secondary base, a secondary support deck arranged for movement relative to said secondary base, and a grip to support the patient for ambulation;

where said modular patient support system is operable between:

a docked configuration where said secondary support deck cooperates with said primary support deck to define a contiguous second patient support area, said primary support deck and said secondary support deck being movable relative to each other to support the patient in a plurality of different bed configurations including a knee brake configuration defined with said secondary support deck arranged at a reflect angle relative to an adjacent section of said primary support deck, and an undocked configuration where said secondary patient support module is spaced apart from said primary patient support module;

said secondary support deck being movable relative to said secondary base when said modular patient support system is in said undocked configuration to promote patient ambulation concurrent with said secondary patient support module and to facilitate access to said grip for supporting the patient for ambulation.

20. The modular patient support system as set forth in claim 19, wherein said secondary support deck of said secondary patient support module is movable to a stowed configuration when said modular patient support system is in said undocked configuration.

21. The modular patient support system as set forth in claim 19, wherein said grip is arranged for movement relative to said secondary base.

22. The modular patient support system as set forth in claim 19, wherein said secondary patient support module is shaped to define a walking access region arranged to promote patient ambulation concurrent with said secondary patient support module when said modular patient support system is in said undocked configuration, wherein said walking access region is arranged at least partially beneath said grip of said secondary patient support module when said modular patient support system is in said undocked configuration.

* * * * *